US008360545B2

(12) United States Patent
Houjou

(10) Patent No.: US 8,360,545 B2
(45) Date of Patent: Jan. 29, 2013

(54) INKJET RECORDING APPARATUS AND INKJET RECORDING METHOD

(75) Inventor: Hiroaki Houjou, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 233 days.

(21) Appl. No.: 12/861,572

(22) Filed: Aug. 23, 2010

(65) Prior Publication Data

US 2011/0043563 A1 Feb. 24, 2011

(30) Foreign Application Priority Data

Aug. 24, 2009 (JP) ..... 2009-193227

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/101, 102, 104
See application file for complete search history.

(56) References Cited

U.S. PATENT DOCUMENTS 8,075,127 B2 * 12/2011 Sugahara ..... 347/102
2004/0174421 A1 9/2004 Tsuji

FOREIGN PATENT DOCUMENTS

JP 2000-153604 A 6/2000
JP 2004-216652 A 8/2004
JP 2008-179012 A 8/2008
JP 2009-35010 A 2/2009

* cited by examiner

*Primary Examiner* — An Do
(74) *Attorney, Agent, or Firm* — Birch, Stewart, Kolasch & Birch, LLP

(57) ABSTRACT

An inkjet recording apparatus includes: a conveyance device having a conveyance device surface with which a rear surface side of a recording medium comes into contact and which includes a plurality of suction holes for suctioning the recording medium with a negative pressure, and conveying the recording medium while changing suction locations of the recording medium suctioned via the suction holes; an inkjet head for ejecting ink onto the recording medium conveyed by the conveyance device in such a manner that an image is formed on the recording medium; and a control device which changes the suction locations of the recording medium suctioned via the suction holes, at a prescribed interval.

20 Claims, 25 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly, to an inkjet recording apparatus and an inkjet recording method whereby a recording medium can be conveyed by vacuum suction conveyance without creating suction marks in the recording medium.

2. Description of the Related Art

An inkjet recording apparatus which carries out recording by depositing ink droplets onto the recording surface of a recording medium is widely used in general applications as an image recording apparatus or an image forming apparatus, such as a printer, a facsimile device, a copying machine, or the like. In an inkjet recording method which uses a water-based ink, since ink droplets are ejected and deposited onto the recording medium, then a phenomenon known as cockling (a swelling deformation of the recording medium due to absorption in the recording medium) occurs due to the water content of the ink bleeding into the recording medium, such as paper, and the recording quality is lowered by this phenomenon.

In particular, in the case of a system which carries out high-speed printing in a single pass using a fixed long head having a high-density arrangement, it is necessary to provide a device for conveying the recording medium reliably with high accuracy compared to the related art, because the floating up of the recording medium itself, and the like, affects recording. It is also necessary to suppress cockling of the recording medium after printing and to improve the drying performance when operating at high speed.

In view of problems of this kind, for example, Japanese Patent Application Publication No. 2008-179012 discloses an apparatus comprising a device which dries a recording medium while conveying the recording medium by suction on a rotating drum, in order to dry the ink on the recording medium after printing reliably in a short time. Furthermore, Japanese Patent Application Publication No. 2009-35010 discloses an apparatus comprising a suctioning unit having a plurality of suction holes provided in the direction of conveyance of the recording medium, the suction holes being closed when no recording medium is conveyed, and the suction holes being successively opened in accordance with the leading end of a recording medium when the recording medium is conveyed. Consequently, when a recording medium which has been recorded is conveyed, it is possible to open only the suction holes in the portion where the leading end of the medium is situated, and therefore it is possible to concentrate the suctioning performance of the fan in the suction holes which are open, and in particular, it is possible to suction reliably the leading end of the recording medium which has strong curl.

Furthermore, Japanese Patent Application Publication No. 2004-216652 discloses an apparatus in which an air flow channel member 14 in which two air flow channels a and b are formed is disposed between a printing platform in which a plurality of suction holes are formed and two suction fans A, B, and the two suction fans A, B and the two air flow channels a, b correspond respectively to two paper conveyance flow channels I, II which are composed in parallel. When printing is carried out only in respect of the paper conveyance flow channel I of the paper conveyance flow channels I and II, the suction fan B corresponding to the paper conveyance flow channel II where printing is not carried out is not driven, whereas only the suction fan A corresponding to the paper conveyance flow channel I where printing is carried out is driven. Japanese Patent Application Publication No. 2000-153604 discloses providing a suction area changing device which changes the effective suction area where a recording material can be suctioned and caused to adhere to a platen having a plurality of suction holes, and a shielding body which shields the suction holes of the platen is disposed movably to act as this changing device, whereby the recording material can be suctioned and caused to adhere stably to the surface of the platen, even if the breadthways dimension of the material in the direction perpendicular to the conveyance direction varies.

However, in the apparatus described in Japanese Patent Application Publication No. 2008-179012, the cellulose bonds in the image portion of the recording medium directly after recording are severed by the water content in the ink, and the image is in a state of reduced rigidity. If the medium is suctioned in this state, then the portions of the image area where the suction holes are disposed become depressed, and since the image area is dried in this state, then the depressions in the suction hole portions remain as suction marks after recording, thus leading to a problem of impaired image quality. Furthermore, if the medium is dried on a conveyance body having a heated surface in order to keep the distance between the inkjet head and the recording medium uniform, and to prevent the recording medium from contacting the head, a prescribed suction time or greater is required in order to promote the heating of the rear surface, but there is a trade-off in that the longer the suction time, the more liable suction marks are to occur in the medium. Moreover, Japanese Patent Application Publication No. 2009-35010 does not recognize the problems relating to depressions (suction marks) which are created by the suction holes, and suction marks have been especially liable to occur in the leading end portion of the recording medium which is suctioned first.

Furthermore, Japanese Patent Application Publication No. 2004-216652 and Japanese Patent Application Publication No. 2000-153604 only describe disabling the operation of the suction mechanism in a non-suctioned region, and make no mention of switching the suction region (recording region).

SUMMARY OF THE INVENTION

The present invention has been contrived in view of these circumstances, an object thereof being to provide an inkjet recording method and an inkjet recording apparatus whereby, when a recording medium after recording is conveyed by vacuum suctioning on the surface of a conveyance body, no suction marks are applied to the medium or the suction marks can be reduced to a visibly indiscernible level, even if the suction time is long.

In order to attain an object described above, one aspect of the present invention is directed to an inkjet recording apparatus comprising: a conveyance device having a conveyance device surface with which a rear surface side of a recording medium comes into contact and which includes a plurality of suction holes for suctioning the recording medium with a negative pressure, and conveying the recording medium while changing suction locations of the recording medium suctioned via the suction holes; an inkjet head for ejecting ink onto the recording medium conveyed by the conveyance device in such a manner that an image is formed on the recording medium; and a control device which changes the suction locations of the recording medium suctioned via the suction holes, at a prescribed interval.

According to this aspect of the invention, in a conveyance device, a recording medium is held by suctioning via suction holes on the opposite side of the medium to the surface where an image is formed, and the locations of the recording medium which are suctioned by the suction holes are changed. Consequently, even if the suction time is long, the same locations of the recording medium are not suctioned consecutively, and therefore it is possible to prevent depressions occurring in the image due to the suctioning via the suction holes. Furthermore, since the suction locations are changed at a prescribed interval, then it is possible to shorten the time during which the recording medium is suctioned in the same positions. Consequently, it is possible to cause the depressions in the recording medium to revert their shape when the suction locations are changed, and therefore the occurrence of depressions in the image due to the suction holes can be prevented during the whole image forming process.

Desirably, the conveyance device is a device which uses a same suction surface to perform conveyance from a start to an end of the conveyance, and includes a switching device for changing the suction locations.

According to this aspect of the invention, when conveying a medium on the same suction surface, for instance, by belt conveyance or on a drum of large diameter, it is possible to perform conveyance while maintaining the suctioned state by changing the suction locations, by means of a switching device.

Desirably, the switching device opens and closes the suction holes.

Desirably, the switching device switches flow channels connected to the suction holes.

According to these aspects of the invention, a specific device forming a suction hole switching device is provided, and the suction holes are switched by physically opening and closing suction holes or switching the flow channel connected to the suction holes. The device for physically opening and closing the suction holes is implemented by adopting a composition in which an intermediate sheet is provided and the suction holes are opened and closed by sliding the intermediate sheet, or providing an opening and closing mechanism in the respective suction holes.

Desirably, the conveyance device includes a plurality of suction conveyance units, arrangement of the suction holes in one suction conveyance unit being different from arrangement of the suction holes in another suction conveyance unit so as to change the suction locations.

According to this aspect of the invention, the switching device is specified for a case where a plurality of suction conveyance units are used, as in the case of drum conveyance, for instance, and it is possible to switch the suction region by making the arrangement of suction holes different in the different suction conveyance units.

Desirably, the control device controls changing of the suction locations according to time.

According to this aspect of the invention, by changing the suction locations through controlling the time, it is possible readily to set the interval at which the suction locations are changed, in accordance with conditions such as the ink droplet ejection volume, the type of recording medium, the thickness, and so on, and therefore it is possible to suppress the occurrence of depressions caused by the suction holes.

Desirably, the control device controls the changing of the suction locations in such a manner that there is overlap between time periods during which suctioning is performed via the suction holes before and after the changing.

According to this aspect of the invention, when changing the suction locations, by providing a time period during which suctioning from the respective suction holes is overlapped by starting the suctioning from another set of suction holes before ending the suctioning from one set of suction holes, it is possible to stabilize the state of suctioning during switching. This is particularly suitable if the recording medium has a certain thickness.

Desirably, the inkjet recording apparatus further comprises a drying device which heats the ink deposited onto the recording medium.

When moisture permeates into the recording medium due to the ejection of droplets, the rigidity of the recording medium declines. Due to the reduction of the rigidity of the recording medium, suction marks become more liable to arise due to the suction holes, and therefore a drying device is provided, the decline in the rigidity of the recording medium is prevented, and depressions in the image can be prevented. This is especially beneficial in cases where the ink droplet ejection volume is large, since the decline in the rigidity of the recording medium is particularly great.

Desirably, the inkjet recording apparatus further comprises a treatment liquid deposition device which deposits treatment liquid having a function of aggregating or increasing viscosity of a component of the ink, onto the recording medium.

According to this aspect of the invention, by providing a treatment liquid deposition device and thereby aggregating and increasing the viscosity of the components in the ink, it is possible to slow the permeation of ink into the recording medium, and therefore it is possible to prevent decline in the rigidity of the recording medium and to prevent the occurrence of depressions in the image. Furthermore, since it is possible to prevent the inflow of ink into the depressions occurring due to suction holes, then density non-uniformities in the image can be suppressed.

Desirably, the ink contains thermoplastic resin particles.

According to this aspect of the invention, since the ink contains thermoplastic resin particles, then it is possible to improve the image strength by carrying out drying.

Desirably, the inkjet recording apparatus further comprises: a drying device which heats the ink deposited onto the recording medium; and a fixing device which heats and pressurizes the recording medium after the drying device in terms of a direction of conveyance of the recording medium.

According to this aspect of the invention, since a fixing device is provided after the drying device, then by applying heat in the fixing device, it is possible to improve the image strength.

Desirably, the ink contains a UV-curable monomer; and the inkjet recording apparatus further comprises a fixing device based on irradiation of UV light.

According to this aspect of the invention, since the ink contains a UV-curable monomer and it is possible to fix the image by irradiation of UV light, then it is possible to improve the image strength and it is also possible to reduce energy consumption.

Desirably, the plurality of suction conveyance units are provided at a location corresponding to the inkjet head.

Desirably, the conveyance device includes a plurality of suction conveyance units, arrangement of the suction holes in one suction conveyance unit being different from arrangement of the suction holes in another suction conveyance unit so as to change the suction locations, and the plurality of suction conveyance units are provided respectively at locations corresponding to the inkjet head and the drying device.

Desirably, the conveyance device includes a plurality of suction conveyance units, arrangement of the suction holes in one suction conveyance unit being different from arrangement of the suction holes in another suction conveyance unit so as to change the suction locations, and the plurality of suction conveyance units are provided respectively at locations corresponding to the treatment liquid deposition device and the inkjet head.

Desirably, the inkjet recording apparatus further comprises a treatment liquid deposition device which deposits treatment liquid having a function of aggregating or increasing viscosity of a component of the ink, onto the recording medium, wherein: the conveyance device includes a plurality of suction conveyance units, arrangement of the suction holes in one suction conveyance unit being different from arrangement of the suction holes in another suction conveyance unit so as to change the suction locations, and the plurality of suction conveyance units are provided respectively at locations corresponding to the treatment liquid deposition device, the inkjet head, the drying device and the fixing device.

The positions where a plurality of conveyance units are provided are specified, the plurality of conveyance units being provided at locations corresponding respectively to the treatment liquid deposition device, the inkjet head, the drying device and the fixing device, and by making the positions of the suction holes different in the respective conveyance units, it is possible to convey a recording medium while varying the positions of the suction holes in the whole process, and therefore it is possible to prevent the occurrence of depressions in the image.

Desirably, arrangement of the suction holes is made different between the suction conveyance units which are mutually adjacent, of the plurality of suction conveyance units.

According to this aspect of the invention, by employing a different arrangement of suction holes in respective conveyance units which are mutually adjacent, the medium is not suctioned consecutively in the same suction regions, and therefore suction marks are not liable to occur and the occurrence of depressions in the image can be prevented.

Desirably, the recording medium is coated paper.

According to this aspect of the invention, since a coated paper is used as the recording medium, then it is possible to slow down the permeation of the ink solvent into the coated paper. Consequently, decline in the rigidity of the recording medium is prevented and the occurrence of depressions in the image can be prevented. Furthermore, coated paper is desirable, since depression marks are less liable to occur than in normal paper, due to the coating layer which is formed in the coated paper.

Desirably, the inkjet head is a full line type inkjet head.

According to this aspect of the invention, since it is possible to prevent depressions in the image due to suction marks, by switching the suctioned regions, then this aspect of the invention can be applied suitably to a printing method which employs a full line type inkjet head having a large droplet ejection volume per unit time.

In order to attain an object described above, another aspect of the present invention is directed to an inkjet recording method comprising: a conveyance step of conveying a recording medium; and an ink ejection step of ejecting ink droplets onto the recording medium to form an image, wherein in the conveyance step, the recording medium is conveyed while a rear surface side with respect to an image forming surface of the recording medium is suctioned, and suction locations of the recording medium are changed at a prescribed interval.

In this aspect of the invention, the inkjet recording apparatus described above is developed as an inkjet recording method, and according to this aspect of the invention, it is In order to attain an object described above, one aspect of possible to obtain similar beneficial effects to the inkjet recording apparatus described above.

According to inkjet recording apparatuses and inkjet recording methods of the present invention, when a recording medium is conveyed while being suctioned, since the recording medium is conveyed while changing the locations of the recording medium which are suctioned, then it is possible to prevent the occurrence of depressions in the image arising due to suctioning of the suction holes as a result of a prolonged suction time.

DESCRIPTION OF THE PREFERRED EMBODIMENTS

A desirable embodiment of an inkjet recording apparatus relating to the present invention is described below with reference to the accompanying drawings.

First Embodiment

General Composition of Inkjet Recording Apparatus

Figure 1:
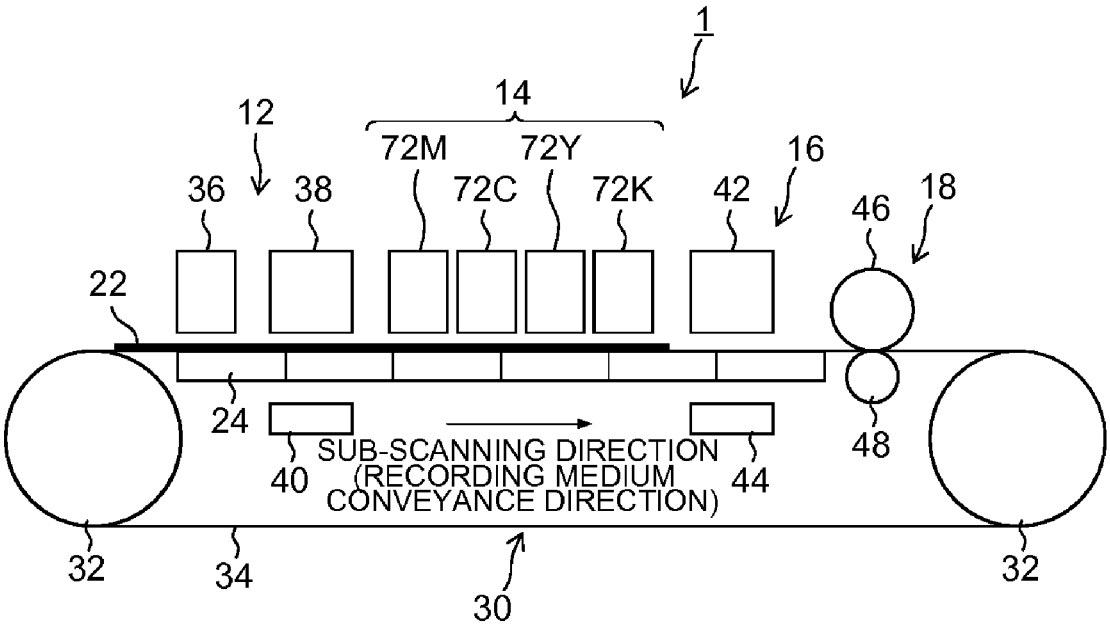
FIG. 1 is a general schematic drawing of an inkjet recording apparatus according to an embodiment of the present invention.

FIG. 1 is a general schematic drawing of an inkjet recording apparatus relating to a first embodiment of the present invention. The inkjet recording apparatus 1 shown in FIG. 1 is a belt conveyance type of inkjet recording apparatus and principally comprises a treatment liquid deposition unit 12, an image formation unit 14, a drying unit 16 and a fixing unit 18, and the recording medium 22 is conveyed by a suction belt conveyance apparatus 30.

The suction belt conveyance apparatus 30 comprises a pair of rollers 32 and an endless belt 34 wrapped about these rollers 32, at least one of the pair of rollers 32 is driven to rotate by a motor, or the like, which is not illustrated. Accordingly, the belt 34 travels in revolution about the pair of rollers 32.

The belt 34 has a width greater than the width of the recording medium 22, and a plurality of suction holes 50 are formed in the upper surface of the belt 34. A suction chamber 24 is provided inside the belt 34, and by setting the suction chamber 24 to a negative pressure by suctioning with a pump, or the like, a suction is created via the suction holes 50 and the recording medium 22 can be suctioned and held.

The recording medium 22 is conveyed from a paper feed unit (not illustrated) to the treatment liquid deposition unit 12 by the suction belt conveyance apparatus 30 described above. The treatment liquid deposition unit 12 comprises a recording head 36 in the form of nozzles, which is composed so as to eject treatment liquid from the recording head 36 toward the recording medium 22. By this means, treatment liquid is deposited onto the recording medium 22 and a treatment liquid layer is formed. There are no particular restrictions on the method whereby the treatment liquid deposition unit 12 ejects treatment liquid from the nozzle-type recording head 36, and it is possible to employ an application method using an application roller.

The recording medium 22 onto which the treatment liquid has been deposited is heated by a heated air supply apparatus 38 which supplies a heated air flow to the upper surface of the recording medium 22 and a heating panel 40 which is disposed below the recording medium 22.

The recording medium 22 which has undergone a drying process is conveyed to the image formation unit 14, whereby droplets of ink are ejected from respective inkjet heads 72M, 72C, 72Y and 72K. Desirably, the inkjet heads 72M, 72C, 72Y and 72K are each constituted by a full line type recording head using an inkjet system (inkjet head) having a length corresponding to the maximum width of the image formation region on the recording medium 22. A nozzle column in which a plurality of ink ejection nozzles are arranged throughout the whole width of the image formation region is formed in the ink ejection surface of each head. Each of the inkjet heads 72M, 72C, 72Y and 72K is disposed so as to extend in a direction perpendicular to the conveyance direction of the recording medium 22.

When droplets of the corresponding colored ink are ejected from the inkjet heads 72M, 72C, 72Y and 72K toward the recording surface of the recording medium 22 which is held tightly on the conveyance belt conveyance apparatus 30, the ink makes contact with the treatment liquid which has previously been deposited onto the recording surface by the treatment liquid deposition unit 12, the coloring material (pigment) dispersed in the ink is aggregated, and a coloring material aggregate is thereby formed. By this means, the flow of coloring material, and the like, on the recording medium 22 is prevented and an image is formed on the recording surface of the recording medium 22.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

A drying unit 16 is provided in a stage after the image formation unit 14. The drying unit 16 is an apparatus which removes the solvent component remaining on the recording medium 22 onto which droplets of inks of the respective colored inks are ejected, and comprises a heated air flow supply apparatus 42 which supplies a heated air flow to the upper surface of the recording medium 22, and a heating panel 44 disposed below the recording medium 22. The solvent on the recording medium 22 is removed by this drying unit 16.

The evaporated water is desirably expelled to the exterior of the machine with the air by means of an expulsion device, which is not illustrated. Furthermore, the recovered air may be cooled by the cooler (radiator), or the like, and the water may be recovered in the form of liquid.

A fixing unit 18 is provided in a stage after the drying unit 16. The fixing unit 18 comprises fixing rollers 46 and 48 which are disposed on either side of the recording medium 22, and the image on the recording medium 22 is fixed to the recording medium 22 by applying pressure and heat by means of the fixing rollers 46 and 48.

Composition of the Suction Holes

Figure 2A:
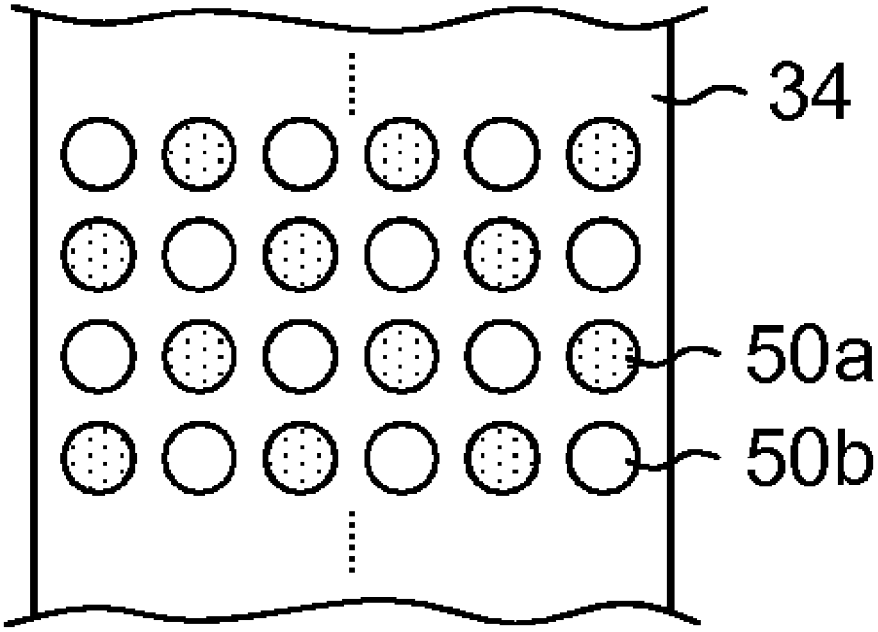
FIGS. 2A and 2B are diagrams showing the arrangement of suction holes.
Figure 2B:
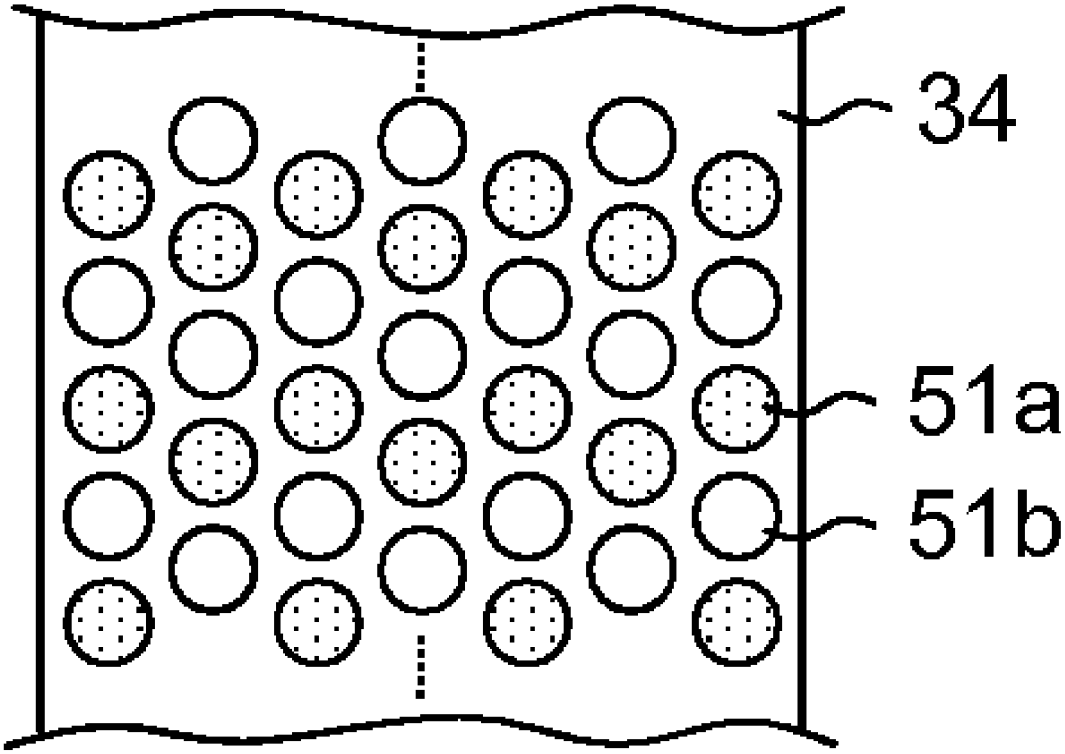

Next, the composition of the suction holes 50 and 51 provided on the belt 34 of the suction belt conveyance apparatus 30 will be described. FIGS. 2A and 2B show concrete examples of the arrangement of suction holes. FIGS. 2A and 2B shows an arrangement of suction holes in a case where a medium is conveyed on the same suction surface, such as the belt conveyance method as described in FIG. 1; FIG. 2A shows a case where first suction holes 50*a* and second suction holes 50*b* are arranged alternately in the front/rear and left/right directions, and FIG. 2B shows a case where the interval between mutually adjacent suction holes is reduced in order to increase the suctioning surface area in comparison with FIG. 2A. There are no particular restrictions on the arrangement of the suction holes, but it is desirable to arrange the first suction holes 50*a* and 51*a* and the second suction holes 50*b* and 51*b* in a uniform fashion as shown in FIGS. 2A and 2B, since this makes it possible to carry out uniform suctioning.

Figure 3A:
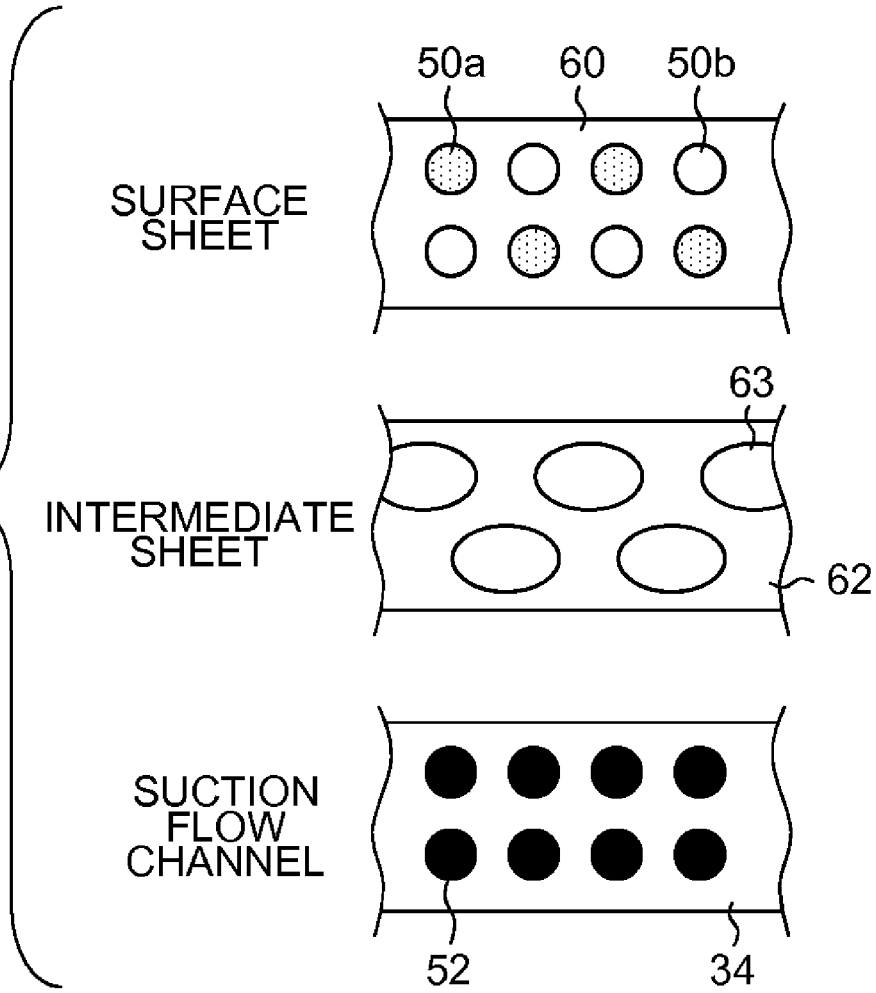
FIGS. 3A to 3D are diagrams showing a suction hole switching device.

FIGS. 3A to 3D and FIGS. 4A and 4B each illustrate a device for switching between the first suction holes 50*a* and the second suction holes 50*b*. FIGS. 3A to 3D are diagrams showing a method for switching the suction holes using an intermediate sheet 62. As shown in FIG. 3A, the suction belt conveyance apparatus 30 comprises a surface sheet 60 in which first suction holes 50*a* and second suction holes 50*b* are formed, a belt 34 in which suction ports of the suction flow channel 52 are formed at positions corresponding to the first suction holes 50*a* and second suction holes 50*b*, and an intermediate sheet 62 provided with suction hole opening and closing apertures 63, disposed between the surface sheet 60 and the belt 34.

By sliding the intermediate sheet 62, either one of the first suction holes 50*a* or the second suction holes 50*b* is closed off, or both the first suction holes 50*a* and the second suction holes 50*b* are opened, whereby the suction region is switched.

Figure 3B:
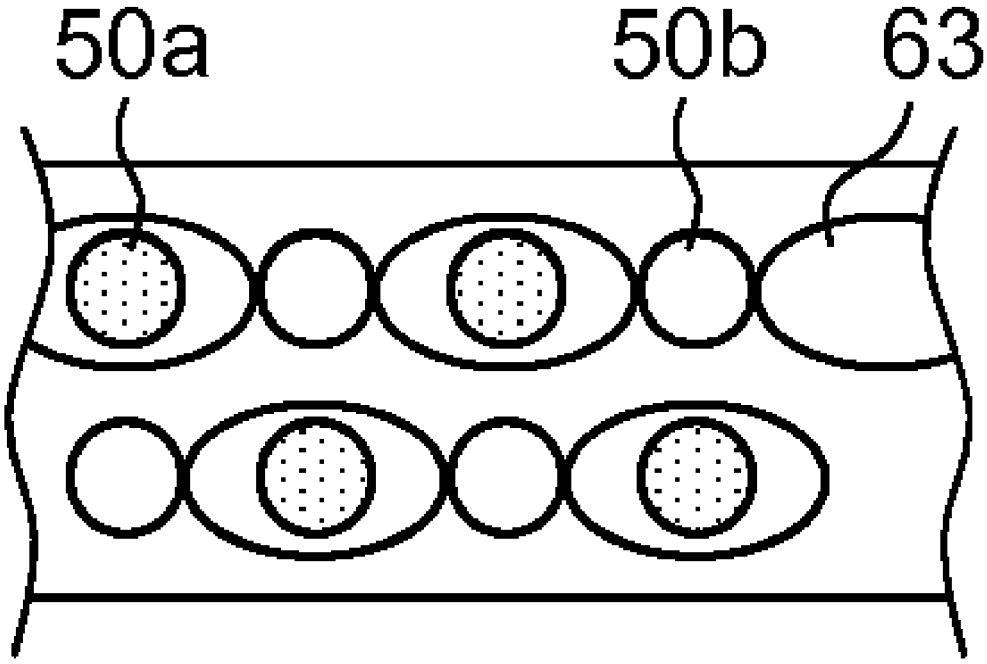
Figure 3C:
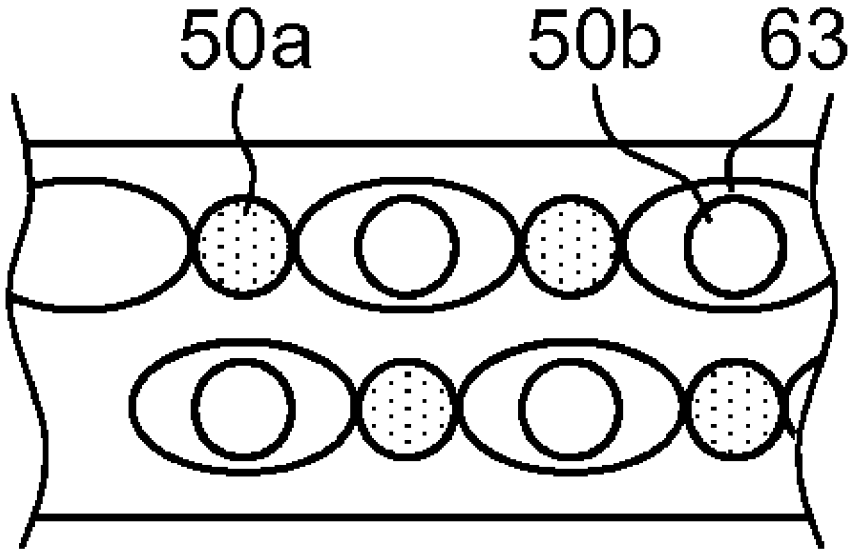
Figure 3D:
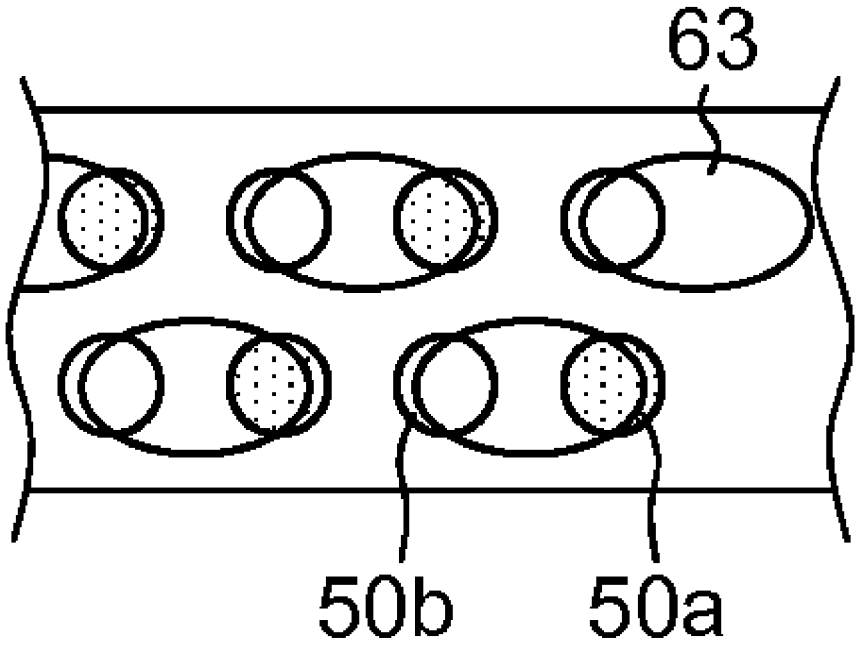

FIGS. 3B to 3D show diagrams where the suction holes are switched by sliding the intermediate sheet 62. FIG. 3B is a diagram in which the intermediate sheet 62 has been slid in such a manner that the suction hole opening and closing apertures 63 and the first suction holes 50*a* are overlapping, and suctioning is performed via the first suction holes 50*a* whereas the second suction holes 50*b* are closed. Conversely, FIG. 3C shows a case where the first suction holes 50*a* are closed off and the second suction holes 50*b* are open and perform suctioning. Furthermore, as shown in FIG. 3D, by adjusting the positions of the suction hole opening and closing apertures 63, it is also possible to slide the intermediate sheet 62 in such a manner that both the first suction holes 50*a* and the second suction holes 50*b* are open. If there is insufficient suctioning when using any one set of the suction holes only, for instance, if using a thick paper for the recording medium, then it is possible to increase the suction force by suctioning with both sets of the suction holes.

As shown in FIGS. 3A to 3D, the suction hole opening and closing apertures are formed with an elliptical shape, but the shape is not limited to this and it is also possible to employ various shapes, provided that they allow any set of suction holes to be opened. Furthermore, the intermediate sheet 62 can be slid in the conveyance direction of the belt or in the direction perpendicular to the conveyance direction.

Figure 4A:
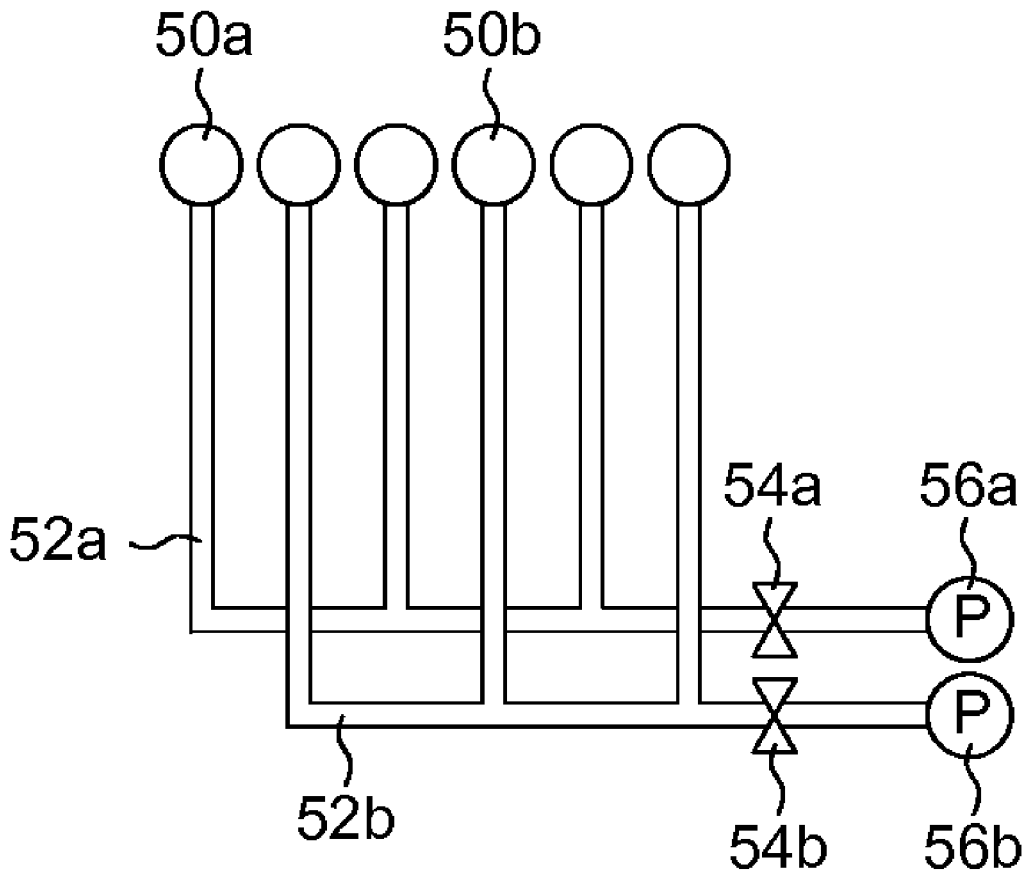
FIGS. 4A and 4B are diagrams showing further examples of a suction hole switching device.
Figure 4B:
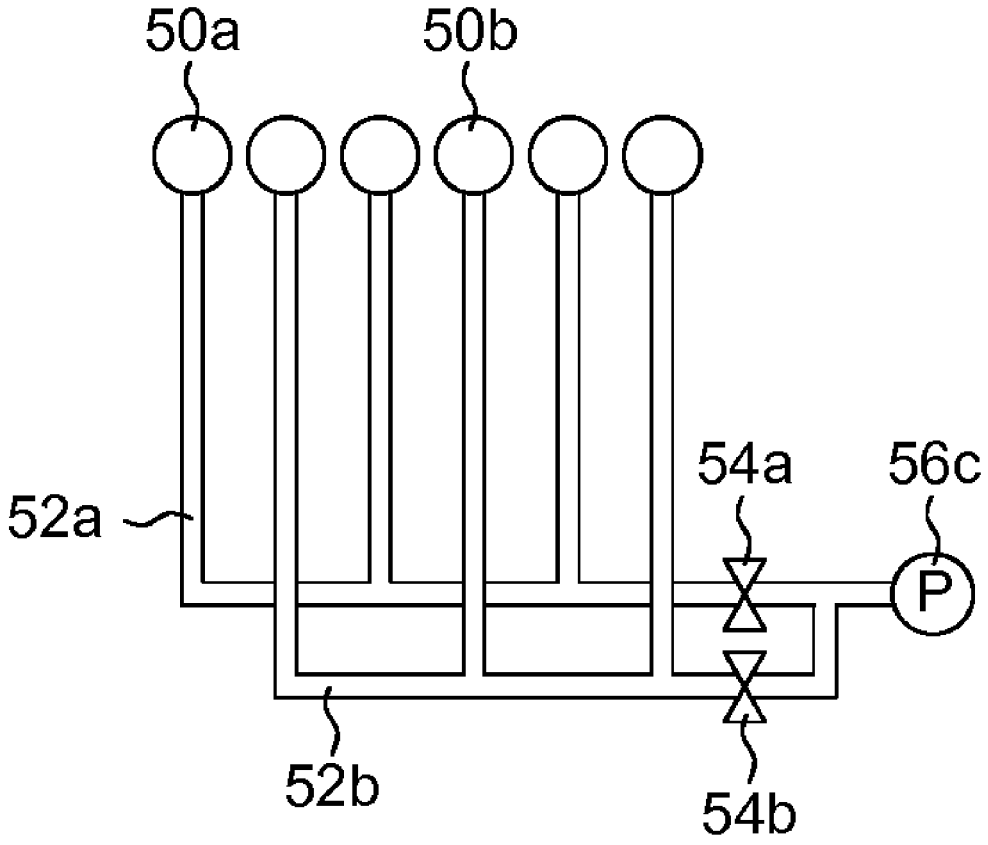

FIGS. 4A and 4B are diagrams each illustrating a method of switching between the first suction holes 50*a* and the second suction holes 50*b* by adjusting a pump connected to suction holes. FIG. 4A is a method in which suction flow channels 52*a*, 52*b*, valves 54*a* and 54*b*, and pumps 56*a* and 56*b*, which are connected to the respective suction holes, namely, the first suction holes 50*a* and the second suction holes 50*b*, are provided and the suctioning of the suction holes is controlled by controlling the operation of the pumps 56*a* and 56*b*. Furthermore, FIG. 4B is the same as FIG. 4A in that suction flow channels 52*a* and 52*b* and valves 54*a* and 54*b* connected to the respective suction holes 50*a* and 50*b* are provided, but differs from FIG. 4A in only one pump 56*c* is provided. If there is one pump, then it is possible to switch the suction holes by controlling the valves 54*a* and 54*b*.

FIGS. 4A and 4B each show a method where switching is carried out by means of suction holes of two types, namely, first suction holes 50*a* and second suction holes 50*b*, but it is also possible to obtain similar beneficial effects in the case of three or more types of suction holes, by similarly increasing the number of suction flow channels, valves and pumps.

Furthermore, as a separate device/method from the devices shown in FIGS. 3A to 3D and FIGS. 4A and 4B, it is also possible to switch the suction region by individually opening the respective suction holes.

If the suction region is switched by means of the intermediate sheet, or if the suction region is switched by opening the suction holes individually, then it is possible to suction the recording medium 22 by suctioning in a state where the suction chamber 24 is fixed as shown in FIG. 1. As shown in FIGS. 4A and 4B, if the suction region is switched by means of a pump or a valve, it is necessary to operate the suction chamber 24 together with the belt 34 to perform suctioning. For example, one possible example is a method where a medium is conveyed while suctioning by forming the belt and the suction chamber as a single body and operating the belt, or by driving the suction chamber by a drive method separate to the belt, joining the belt and the suction chamber in the treatment liquid deposition unit, and separating same in the drying unit.

Figure 5A:
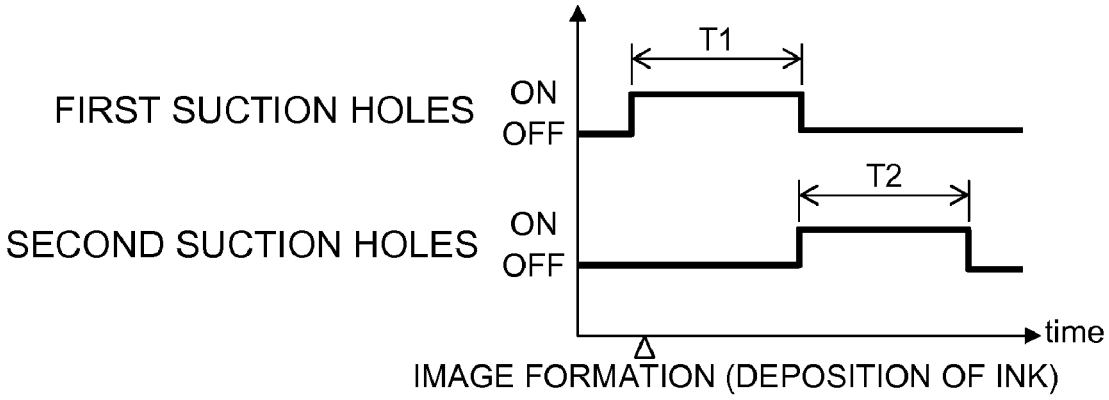
FIGS. 5A to 5D are timetables showing the switching times of the suction region.

FIGS. 5A to 5D show graphs of the timetable of switching in a case where the switching is performed by using suction holes of two types as shown in FIGS. 3A to 3D and FIGS. 4A and 4B. FIG. 5A is a timetable of a case where suctioning is carried out using the first suction holes in the first half of the suction time and suctioning is carried out using the second suction holes in the second half of the suction time. By switching between the first suction holes and the second suction holes in this way, it is possible to prevent the same image portion from being suctioned continuously, and therefore it is possible to prevent suction marks from being applied to the recording medium. Desirably, the time periods T1, T2, . . . are controlled suitably in accordance with the ink droplet ejection volume, the type of recording medium and the thickness of the recording medium. For example, if the droplet ejection volume is 100%, then T1 can be set to 1 s, and if the droplet ejection volume is 200%, then T1 can be set to 2 s.

Figure 5B:
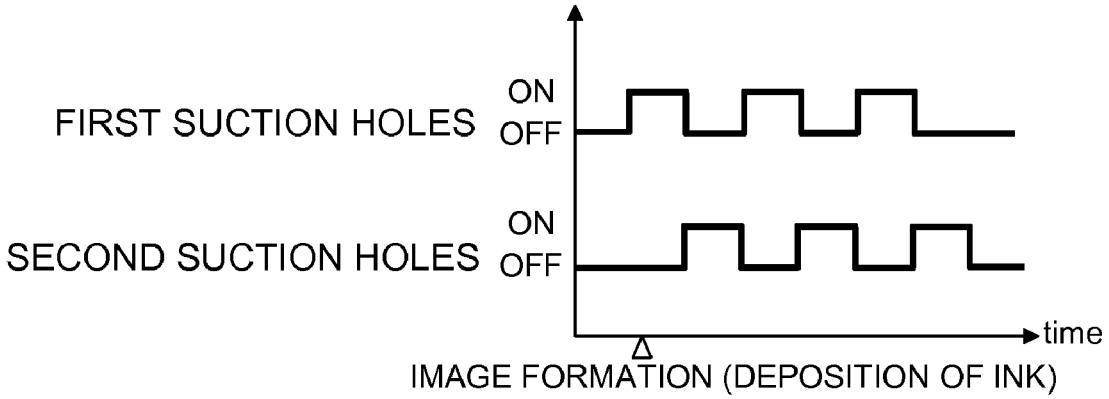

FIG. 5B is a timetable in which the suction time per operation is shortened. If thin paper is used as the recording medium, then there is a decline in the rigidity of the paper if water permeates thereinto, and therefore suction marks are liable to occur. Consequently, it is possible to suppress the occurrence of suction marks by shortening the suction time per operation and increasing the number of times that the suction region is switched. Carrying out suctioning on the basis of the timetable shown in FIG. 5B is especially beneficial if using a recording medium having a basis weight lower than 104.7 gsm (Gram per Square Meter).

Figure 5C:
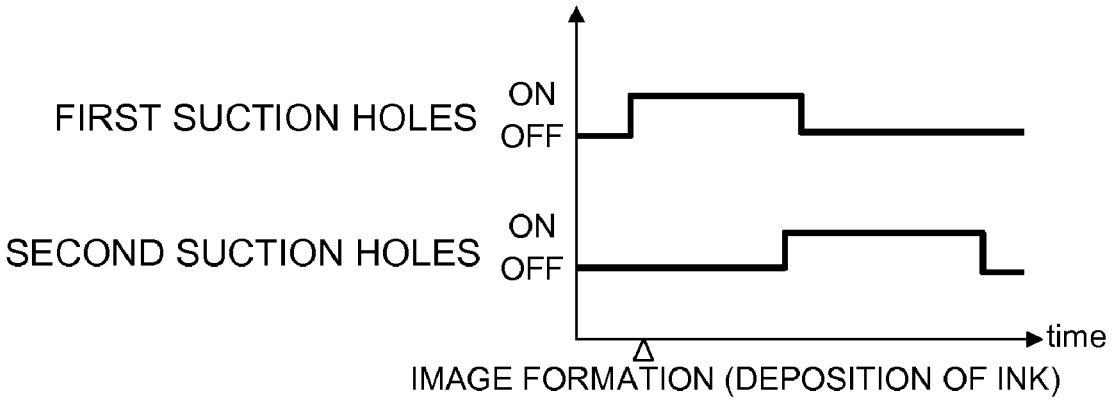
Figure 5D:
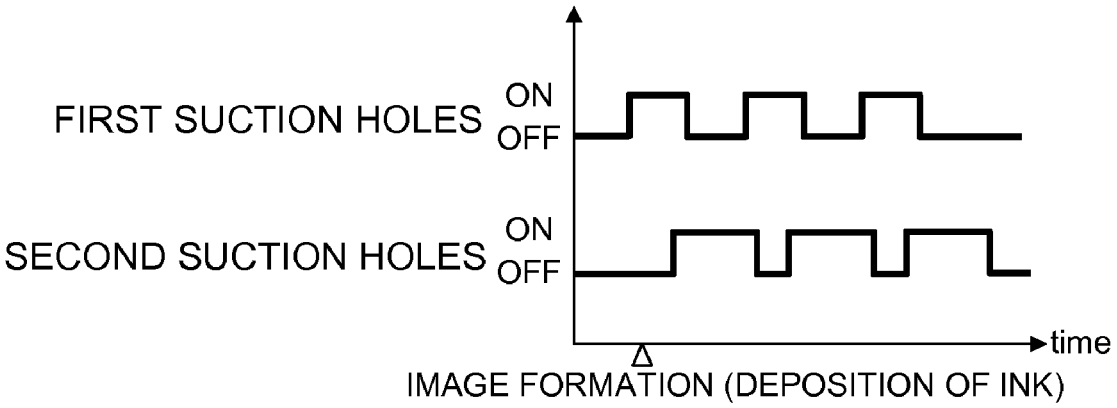

FIG. 5C and FIG. 5D show cases where time periods in which both the first suction holes and the second suction holes are operated are provided in the switching of the first suction holes and the second suction holes according to the timetables in FIG. 5A and FIG. 5B. In the case of a recording medium which produces marked cockling, such as when using thin paper as the recording medium, for instance, there is a concern that wrinkles may occur due to the effects of cockling caused by the momentary release of the suction pressure when switching the suction region. Consequently, at the end of the suction time of the first suction holes, at the start of the second suction time, and during the reverse switching operation, it is possible to achieve stable switching by implementing control whereby the suction times are mutually overlapping for a short period of time, thereby making it possible to prevent the occurrence of wrinkles. Furthermore, if the recording medium has a certain thickness, then it is possible to suction the medium in a stable state.

It is necessary to select the switching of the suction holes appropriately in accordance with the basis weight of the recording medium, because if the paper is thick, then although suction marks are not liable to occur, the suction force is insufficient, and if the paper is thin, then although the suction force is sufficient, suction marks are liable to occur and furthermore, wrinkles are liable to arise.

FIGS. 5A to 5D show cases of a composition which switches between two types of suction holes, but there are no particular restrictions on the type of suction holes which are switched, and it is possible to use three or more types of suction holes, provided that switching between the suction holes is possible.

Furthermore, the first embodiment is described with reference to the example of a belt conveyance, but one possible alternative method for conveying the medium on the same suctioning surface is a conveyance method using a single large-diameter drum. Even when using a single large-diameter drum, it is possible to obtain similar beneficial effects by employing the same arrangement of suction holes and the same switching of the suctioning operation.

Furthermore, when using a large-diameter drum, it can be imagined that the suction force can be weak if the basis weight of the recording medium is high, and hence the trailing end of the recording medium can float up and the recording medium can make contact with the inkjet head, and the like. Therefore, it is necessary to set the suction force, suction regions, and the like, appropriately in accordance with the type of recording medium.

Second Embodiment

Figure 6:
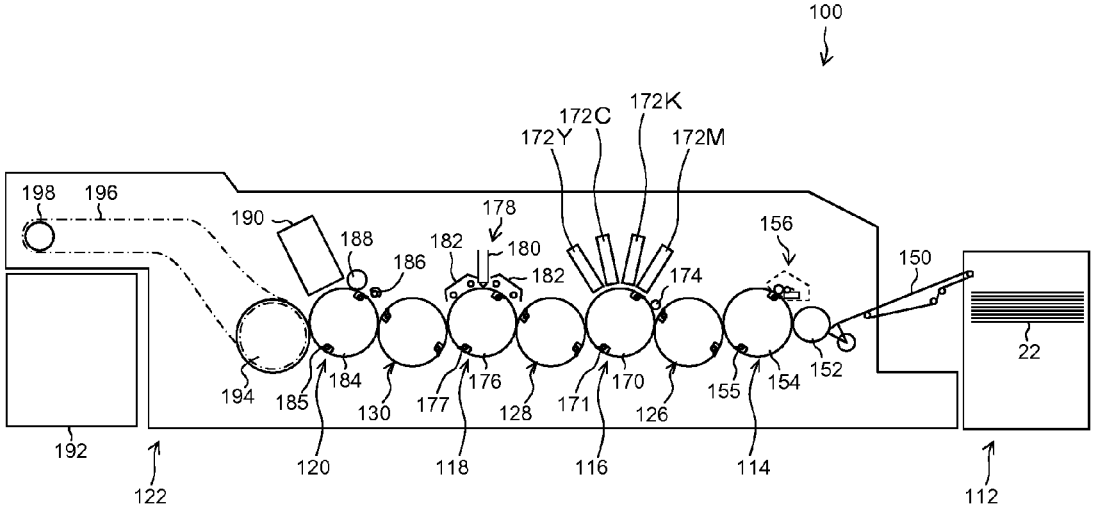
FIG. 6 is a general schematic drawing of an inkjet recording apparatus which is different to FIG. 1.

FIG. 6 is a general schematic drawing of an inkjet recording apparatus relating to a second embodiment of the present invention. This inkjet recording apparatus 100 is an inkjet recording apparatus using a pressure drum direct image formation method, which forms a desired color image by ejecting droplets of inks of a plurality of colors from inkjet heads 172M, 172K, 172C and 172Y onto a recording medium 22 (also called "paper" below for the sake of convenience) held on a pressure drum (image formation drum 170) of an image formation unit 116. The inkjet recording apparatus 100 is an image forming apparatus of an on-demand type employing a two-liquid reaction (aggregation) method in which an image is formed on a recording medium 22 by depositing a treatment liquid (here, an aggregating treatment liquid) on a recording medium 22 before ejecting droplets of ink, and causing the treatment liquid and ink liquid to react together. Elements of the composition and action which are substantially the same as the inkjet recording apparatus 1 shown in FIG. 1 are labeled with the same reference numerals and description thereof is omitted here.

As shown in FIG. 6, the inkjet recording apparatus 100 principally comprises a paper feed unit 112, a treatment liquid deposition unit 114, an image formation unit 116, a drying unit 118, a fixing unit 120 and an output unit 122.

Paper Feed Unit

The paper feed unit 112 is a mechanism for supplying a recording medium 22 to the treatment liquid deposition unit 114, and recording media 22, which are cut sheet paper, are stacked in the paper feed unit 112. A paper feed tray 150 is provided with the paper feed unit 112, and a recording medium 22 is supplied one sheet at a time to the treatment liquid deposition unit 114 from the paper feed tray 150.

In the inkjet recording apparatus 100 according to the present example, it is possible to use recording media 22 of a plurality of types having different material and dimensions (paper size). It is also possible to use a mode in which a plurality of paper trays (not illustrated) in which recording media of different types are stacked respectively and separately are provided in the paper feed unit 112, and a paper supplied from the paper feed tray 150 of this plurality of paper trays is switched automatically, or a mode in which the operator selects the paper tray or replaces the paper tray according to requirements. In the present embodiment, cut sheet paper (cut paper) is used as the recording medium 22, but it is also possible to adopt a composition in which paper is supplied from a continuous roll (rolled paper) and is cut to the required size.

Treatment Liquid Deposition Unit

The treatment liquid deposition unit 114 is a mechanism which deposits treatment liquid onto the recording surface of the recording medium 22. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

As shown in FIG. 6, the treatment liquid deposition unit 114 comprises a paper feed drum 152, a treatment liquid drum 154 and a treatment liquid application apparatus 156. The treatment liquid drum 154 is a drum which holds the recording medium 22 and conveys the medium to rotate. The treatment liquid drum 154 comprises a hook-shaped gripping device (gripper) 155 provided on the outer circumferential surface thereof, and is devised in such a manner that the leading end of the recording medium 22 can be held by gripping the recording medium 22 between the hook of the holding device 155 and the circumferential surface of the treatment liquid drum 154.

A treatment liquid application apparatus 156 is provided opposing the circumferential surface of the treatment liquid drum 154, to the outside of the drum 154. The treatment liquid application apparatus 156 comprises a treatment liquid vessel in which treatment liquid is stored, an anilox roller which is partially immersed in the treatment liquid in the treatment liquid vessel, and a rubber roller which transfers a dosed amount of the treatment liquid to the recording medium 22, by being pressed against the anilox roller and the recording medium 22 on the treatment liquid drum 154. According to this treatment liquid application apparatus 156, it is possible to apply the treatment liquid to the recording medium 22 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 22 onto which the treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 comprises an image formation drum (second conveyance body) 170, a paper pressing roller 174, and inkjet heads 172M, 172K, 172C and 172Y. Similarly to the treatment liquid drum 154, the image formation drum 170 comprises a hook-shaped holding device (gripper) 171 on the outer circumferential surface of the drum. The recording medium 22 held on the image formation drum 170 is conveyed with the recording surface thereof facing to the outer side, and ink is deposited onto this recording surface from the inkjet heads 172M, 172K, 172C and 172Y.

The recording medium 22 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which dries the water content contained in the solvent which has been separated by the action of aggregating the coloring material, and as shown in FIG. 6, comprises a drying drum (conveyance body) 176 and a solvent drying apparatus 178.

Similarly to the treatment liquid drum 154, the drying drum 176 comprises a hook-shaped holding device (gripper) 177 provided on the outer circumferential surface of the drum, in such a manner that the leading end of the recording medium 22 can be held by the holding device 177.

The solvent drying apparatus 178 is disposed in a position opposing the outer circumferential surface of the drying drum 176, and is constituted by infrared heaters 182 and a heated air flow spraying nozzle 180 disposed between the infrared heaters 182.

It is possible to achieve various drying conditions, by suitably adjusting the temperature and air flow volume of the heater air flow which is blown from the heated air flow spraying nozzle 180 toward the recording medium 22, and the temperatures of the respective infrared heaters 182.

The recording medium 22 on which a drying process has been carried out in the drying unit 118 is received from the drying drum 176 to the fixing drum 184 of the fixing unit 120 via the intermediate conveyance unit 130.

Fixing Unit

The fixing unit 120 is constituted by a fixing drum 184, a halogen heater 186, a fixing roller 188 and an in-line sensor 190. Similarly to the treatment liquid drum 154, the fixing drum 184 comprises a hook-shaped holding device (gripper) 185 provided on the outer circumferential surface of the drum, in such a manner that the leading end of the recording medium 22 can be held by the holding device 185.

By means of the rotation of the fixing drum 184, the recording medium 22 is conveyed with the recording surface facing to the outer side, and preliminary heating by the halogen heater 186, a fixing process by the fixing roller 188 and inspection by the in-line sensor 190 are carried out in respect of the recording surface.

The halogen heater 186 is controlled to a prescribed temperature (for example, 180° C.). By this means, preliminary heating of the recording medium 22 is carried out.

The fixing roller 188 is a roller member for melting self-dispersing thermoplastic resin particles contained in the ink and thereby causing the ink to form a film (membrane), by applying heat and pressure to the dried ink, and is composed so as to heat and pressurize the recording medium 22. More specifically, the fixing roller 188 is disposed so as to press against the fixing drum 184, in such a manner that a nip is created between the fixing roller 188 and the fixing drum 184. By this means, the recording medium 22 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller formed by a metal pipe of aluminum, or the like, having good thermal conductivity, which internally incorporates a halogen lamp, and is controlled to a prescribed temperature (for example, 60 to 80° C.). By heating the recording medium 22 by means of this heating roller, thermal energy equal to or greater than the Tg temperature (glass transition temperature) of the thermoplastic resin particles contained in the ink is applied and the thermoplastic resin particles are thereby caused to melt. By this means, fixing is performed by pressing the resin particles into the projection-recess indentations in the recording medium 22, as well as leveling projection-recess indentations in the image surface and obtaining a glossy finish.

In the inkjet recording apparatus shown in FIG. 6, only one fixing roller 188 is provided, but it is also possible to provide fixing rollers in a plurality of stages, in accordance with the thickness of the image layer and the Tg characteristics of the thermoplastic resin particles.

On the other hand, the in-line sensor 190 is a measurement device for measuring a test pattern (check pattern), the amount of moisture, the surface temperature, the glossiness, and the like, of the image fixed on the recording medium 22; and a CCD line sensor, or the like, is employed for the in-line sensor 190.

According to the fixing unit 120 having the composition described above, the thermoplastic resin particles in the thin image layer formed by the drying unit 118 are heated, pressurized and melted by the fixing roller 188, and hence the image layer can be fixed to the recording medium 22. Furthermore, by setting the surface temperature of the fixing drum 184 to 50° C. or above, drying is promoted by heating the recording medium 22 held on the outer circumferential surface of the fixing drum 184 from the rear surface, and therefore breaking of the image during fixing can be prevented, and furthermore, the strength of the image can be increased by the effects of the increased temperature of the image.

Moreover, in cases where an ultraviolet-curable monomer is included in the ink, after the water has been evaporated off sufficiently in the drying unit, ultraviolet light is irradiated onto the image by a fixing unit comprising an ultraviolet irradiation lamp, thereby curing and polymerizing the ultraviolet-curable monomer and making it possible to improve the strength of the image.

Output Unit

As shown in FIG. 6, an output unit 122 is provided subsequently to the fixing unit 120. The output unit 122 comprises an output tray 192, and a transfer drum 194, a conveyance belt 196 and a tensioning roller 198 are provided between the output tray 192 and the fixing drum 184 of the fixing unit 120 so as to oppose same. The recording medium 22 is sent to the conveyance belt 196 by the transfer drum 194 and output to the output tray 192.

Furthermore, although not shown in the drawings, the inkjet recording apparatus 100 according to the present embodiment comprises, in addition to the composition described above, an ink storing and loading unit which supplies ink to the inkjet heads 172M, 172K, 172C and 172Y, and a device which supplies treatment liquid to the treatment liquid deposition unit 114, as well as comprising a head maintenance unit which carries out cleaning (nozzle surface wiping, purging, nozzle suctioning, and the like) of the inkjet heads 172M, 172K, 172C and 172Y, a position determination sensor which determines the position of the recording medium 22 in the paper conveyance path, a temperature sensor which determines the temperature of the respective units of the apparatus, and the like.

Composition of Drum

In the present embodiment, the treatment liquid drum 154, the image formation drum 170, the drying drum 176 and the fixing drum 184 have suction holes provided in the outer circumferential surface thereof, and have a suctioning device which performs suctioning via the suction holes. By this means, it is possible to hold the recording medium 22 tightly against the circumferential surfaces of the respective drums. Furthermore, it is possible to hold the recording medium against the conveyance body by carrying out negative pressure suctioning, and therefore it is possible to prevent cockling of the recording medium.

Moreover, by holding and conveying the recording medium 22 with the recording surface of the medium facing toward the outer side (in other words, in a state where the recording surface of the recording medium 22 is curved in a convex shape), as in the apparatus shown in FIG. 6, it is possible to prevent the occurrence of wrinkling or floating up of the recording medium 22.

If the shape of the suction holes is a square (acute) shape, then stress is concentrated in the corner portions, and therefore it is desirable to form the corner portions with a rounded shape.

Next, the concrete structure of the vacuum suction method will be described.

Figure 7:
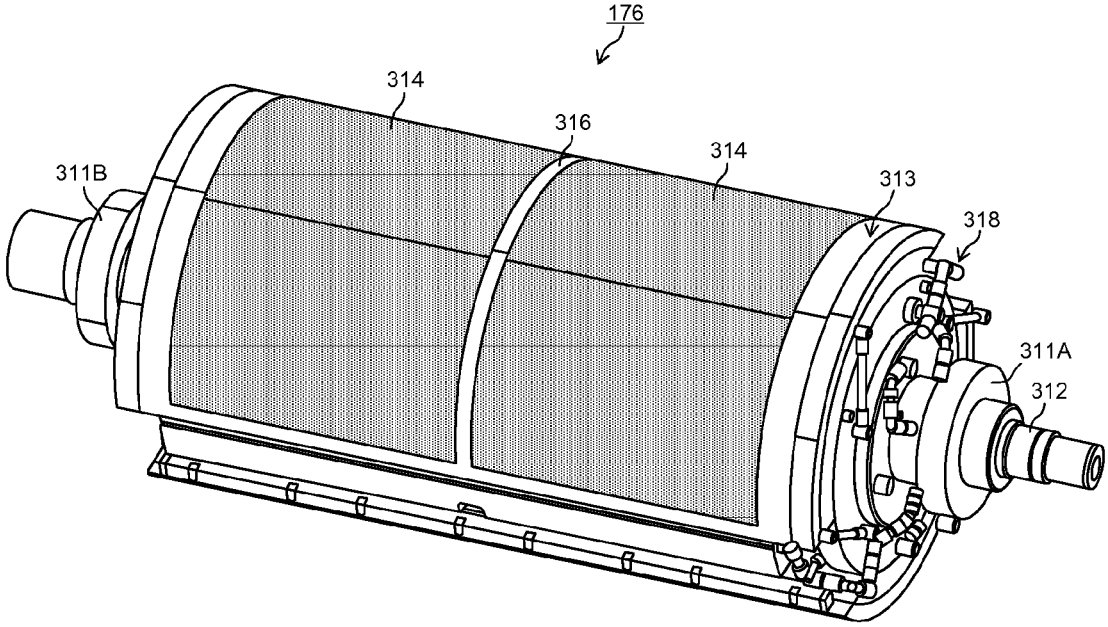
FIG. 7 is a perspective diagram showing the overall structure of a drying drum.

FIG. 7 is a perspective diagram showing the overall structure of the drying drum 176. In the description in FIG. 7, a drying drum 176 is used, the treatment liquid drum 154, the image formation drum 170 and the fixing drum 184 may also adopt a similar composition. As shown in FIG. 7, the drying drum 176 is a rotating member which is connected to a rotating mechanism (not illustrated) and is composed so as to be rotatable about a rotational shaft 312 supported by bearings 311A and 311B, due to the operation of the rotating mechanism.

Furthermore, recording medium holding regions 314 (the dot-hatched regions in FIG. 2) are provided on the recording medium holding surface (circumferential surface) 313 of the drying drum 176 on which the recording medium 22 (see FIG. 6) is held (and fixed), and a plurality of suction holes (openings) are provided in the recording medium holding regions 314. On the other hand, a closed portion 16 where no suction holes are provided is formed in the approximate central portion in terms of the axial direction of the drying drum 176 (the direction parallel to the rotating axle 312). For the sake of convenience, FIG. 7 does not depict the respective suction holes independently, but in FIG. 10 the suction holes are depicted by reference numeral 350.

A vacuum flow channel which connects to the suction holes is provided inside the drying drum 176 illustrated in FIG. 7, and the vacuum flow channel is connected to a vacuum pump provided to the exterior of the drying drum 176 (not illustrated in FIG. 2 and depicted as a suction pressure generating device indicated by reference numeral 442 in FIG. 13), via a vacuum piping system 318 provided on the side face of the drying drum 176 (comprising tubes, joints, and the like), and a vacuum flow channel provided inside the rotating axle 312 of the drying drum 176. When a vacuum (negative pressure) is generated by operating the vacuum pump, a suction pressure is applied to the recording medium 22 via the suction holes, the vacuum flow channel, and the like. In other words, the drying drum 176 is composed in such a manner that the recording medium 22 is held on the circumferential surface which forms a recording medium holding surface 313, by means of an air suction system.

Next, the structure of the vacuum flow channel inside the drying drum 176 will be described.

Figure 8:
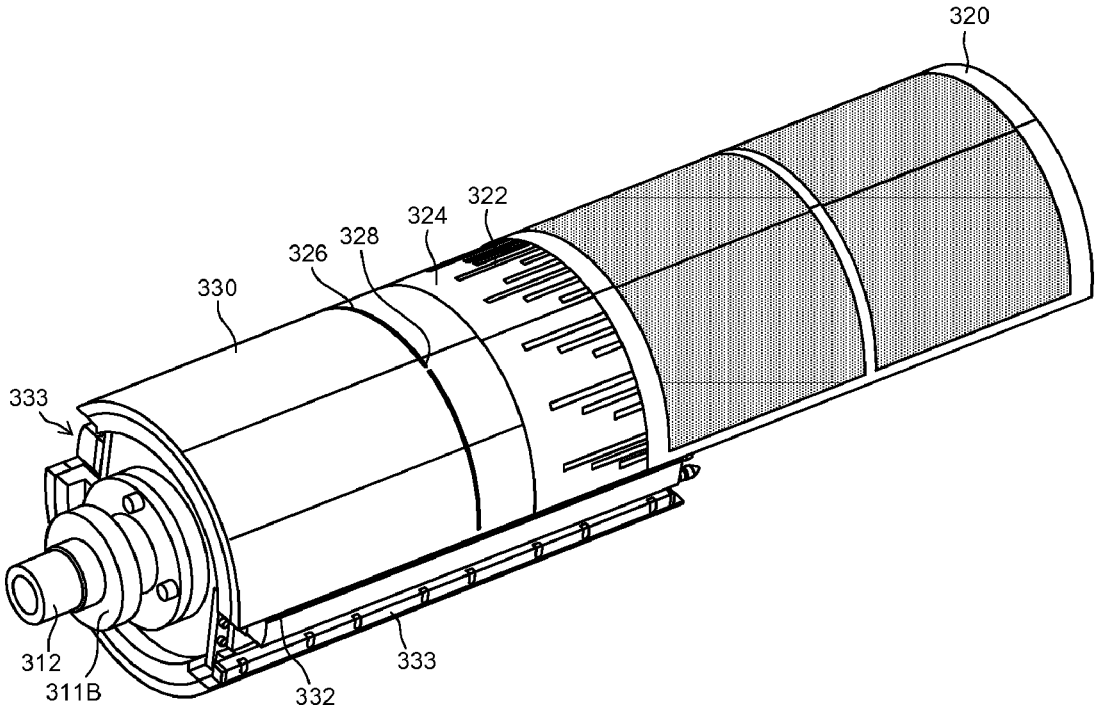
FIG. 8 is an exploded perspective diagram showing the internal structure of the drying drum shown in FIG. 7.

FIG. 8 is an exploded perspective diagram illustrating the internal structure of the drying drum 176. As illustrated in FIG. 8, the drying drum 176 comprises a suction sheet 320 in which a plurality of suction holes are provided, and an intermediate sheet 324 in which a plurality of suction grooves 322 (flow channel forming sections having opening sections) which are connected to the suction holes are provided in accordance with a prescribed arrangement pattern, and furthermore it also comprises a drum main body 330 comprising a drum suction groove 326 (pressure generating section).

Furthermore, a drum suction hole 328 which is connected to the vacuum flow channel (not illustrated) provided inside the drum main body 330 is provided in the end portion of the drum suction groove 326 which is provided on the drum main body 330.

As illustrated in FIG. 8, the drying drum 176 has a structure in which the drum suction groove 326 of the drum main body 330 and the restrictor sections (flow channel control sections) of the intermediate sheet 324 are aligned in position and the intermediate sheet 324 is wrapped about the circumferential surface of the drum main body 330 and fixed in tight contact with same, and furthermore, the suction grooves 322 of the intermediate sheet 324 are aligned in position with the suction holes of the suction sheet 320 in such a manner that suction holes provided in the suction sheet 320 connect with the suction grooves 322 of the intermediate sheet 324, and the suction sheet 320 is wrapped over the intermediate sheet 324 and fixed in tight contact with same.

Desirably, the arrangement pattern of the suction holes provided in the suction sheet 320 corresponds to the pattern of the suction grooves 322 in the intermediate sheet 324. Some of the suction holes may not be connected to the suction grooves 322.

Next, the suction sheet 320 will be described in detail.

Figure 9:
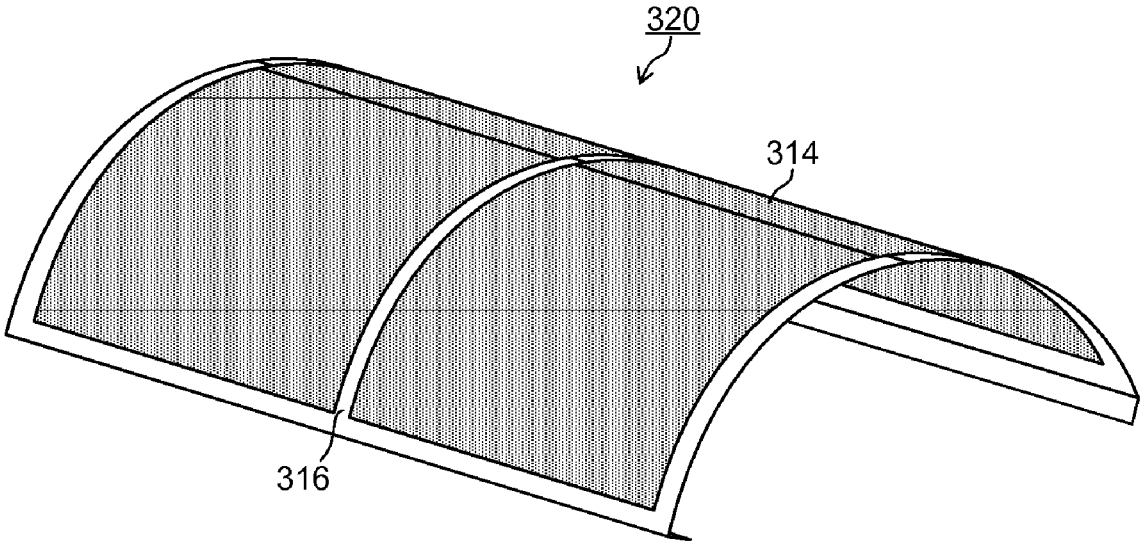
FIG. 9 is a perspective diagram showing the structure of the suction sheet shown in FIG. 8.
Figure 10:
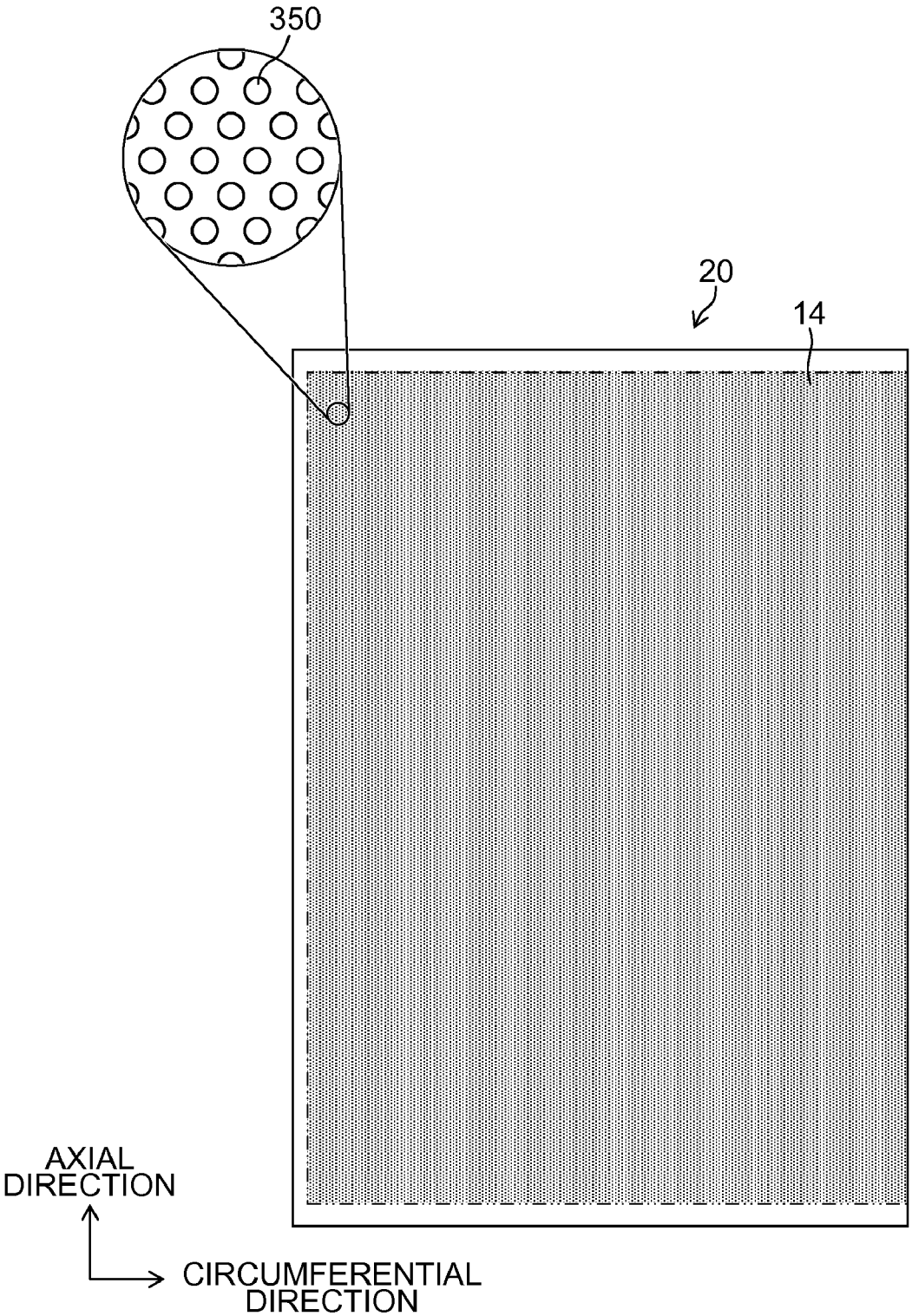
FIG. 10 is a partially enlarged diagram of the suction sheet shown in FIG. 9.

FIG. 9 is a perspective diagram of the suction sheet 320, and FIG. 10 is a partially enlarged view of the suction sheet 320 illustrated in FIG. 9.

As illustrated in FIG. 9, a plurality of suction holes (not illustrated in FIG. 9 and indicated by reference numeral 350 in FIG. 10) are provided according to a prescribed arrangement pattern in the recording medium holding region 314 of the suction sheet 320. Furthermore, the approximate central portion of the suction sheet 320 in the axial direction of the drying drum 176 forms a closed section 316 where no suction hole 350 is provided. Moreover, either ends of the suction sheet 320 in the circumferential direction of the drying drum 176 form a fold structure (L-shaped bend structure) for fixing to the drum main body 330.

FIG. 10 illustrates a mode where suction holes 350 are provided in a staggered matrix arrangement in order to dispose a plurality of suction holes 350 at high density. Of course, it is also possible to adopt an arrangement pattern other than a staggered matrix pattern for the arrangement of the suction holes 350.

Next, the method of fixing the suction sheet 320 and the intermediate sheet 324 will be described.

Firstly, the suction sheet 320 is laid over the intermediate sheet 324 and wrapped about the drum main body 330. By providing the suction sheet 320 and the intermediate sheet 324 with positional alignment marks and shapes, the two sheets can be aligned together in position, easily and accurately.

Thereupon, one fold structure of the suction sheet 320 and the fold structure of the intermediate sheet 324 are inserted into the gripper 332 of the drum main body 330 and fixed thereby. By providing cutaway sections in the fold structure of the suction sheet 320 and the hold structure of the intermediate sheet 324, and providing projecting sections which fit together with the cutaway sections in the gripper 332, it is possible to align the positions of the suction sheet 320, the intermediate sheet 324 and the drum main body 330 easily and accurately, when the one fold structure of the suction sheet 320 and the fold structure of the intermediate sheet 324 are inserted into the gripper 332 of the drum main body 330.

The other fold structure of the suction sheet 320 is attached to the tensioning mechanism 333 on the drum main body 330, and tension is applied in the circumferential direction by the tensioning mechanism 333. The end portion of the intermediate sheet 324 on the side where the fold structure is not provided is gripped in close contact between the suction sheet 320 and the drum main body 330.

In this way, it is possible to fix the suction sheet 320 and the intermediate sheet 324 in a state of close mutual contact about the curved circumferential surface of the drum main body 330.

In the present embodiment, a mode is described in which a portion of the vacuum flow channel is formed by combining two sheets (a suction sheet 320 and an intermediate sheet 324), but it is also possible to form the suction holes 350, the suction grooves 322 and the restrictor sections (not illustrated) in one sheet which serves both as the suction sheet 320 and the intermediate sheet 324. For example, it is possible to realize the suction sheet 320 and the intermediate sheet 324 in a single sheet by processing the suction holes 350 in one surface of a sheet and processing the suction grooves 322 and the restrictor sections in other surface.

Furthermore, in the present embodiment, in each of the drums, namely, the treatment liquid drum 154, the image formation drum 170, the drying drum 176 and the fixing drum 184, the arrangement of the suction holes 350 or the suctioning of the suction holes 350 are designed in such a manner that the positions where the recording medium 22 is suctioned from the suction holes 350 formed in the drums are mutually different. Consequently, it is possible to suppress the occurrence of depressions caused by suction holes by preventing the recording medium from being suctioned at the same positions.

Figure 11A:
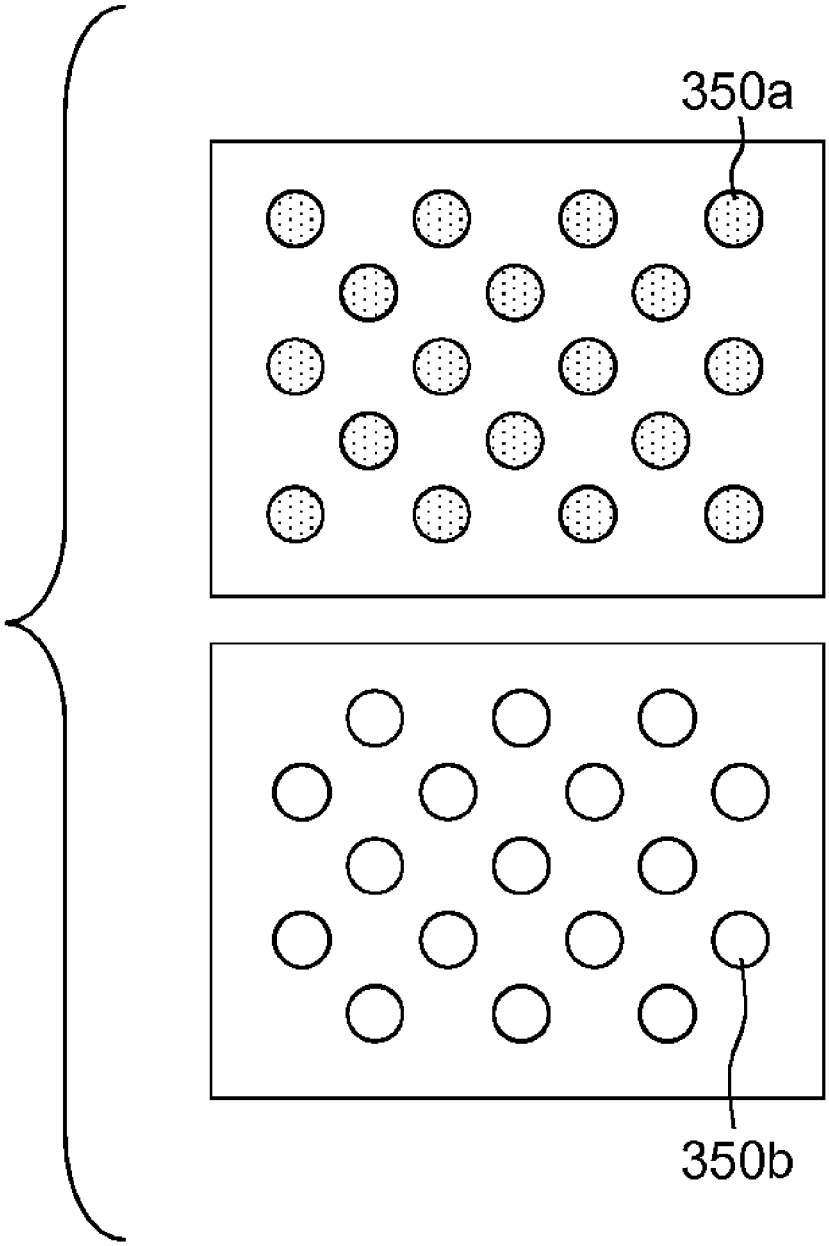
FIG. 11A shows the arrangement of suction holes in respective drums and FIG. 11B shows the regions which are suctioned by the suction holes during the entire image forming process.
Figure 11B:
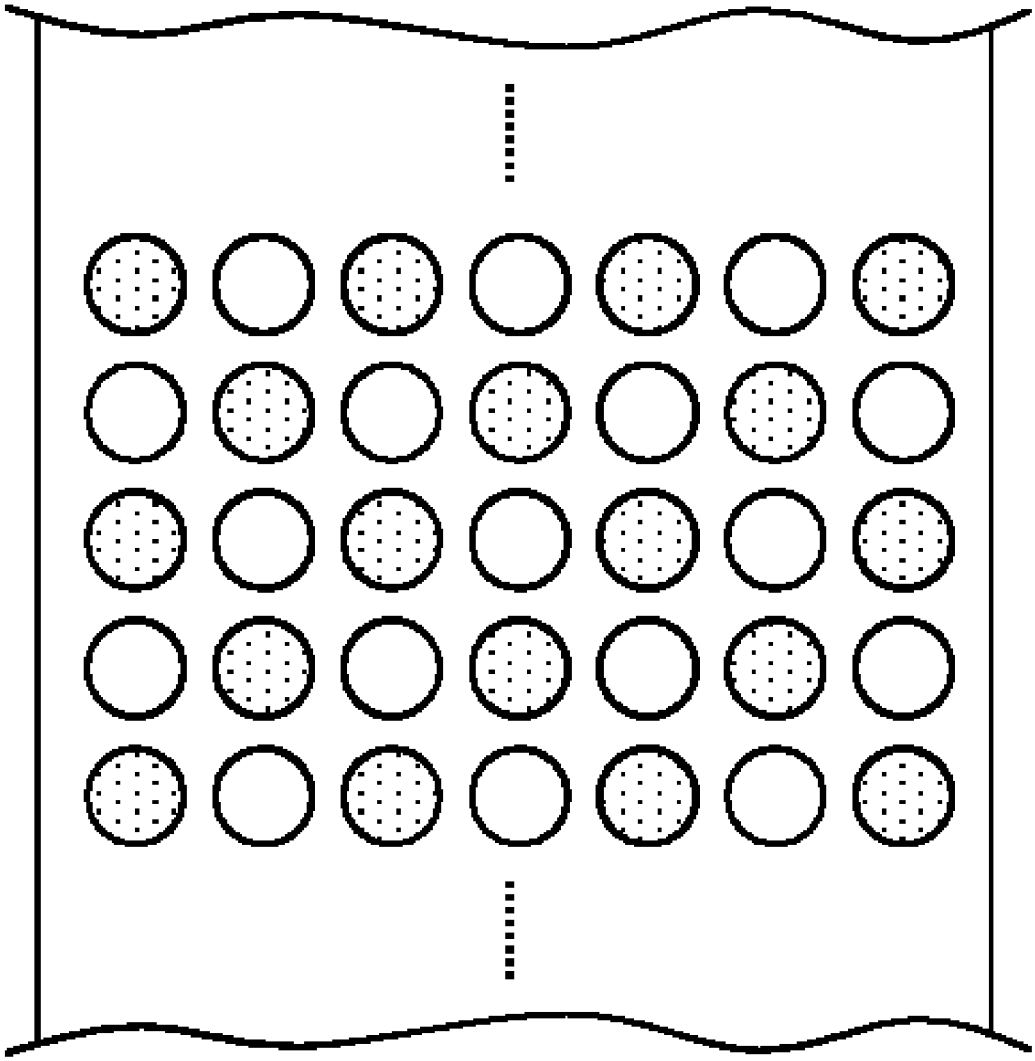
Figure 12A:
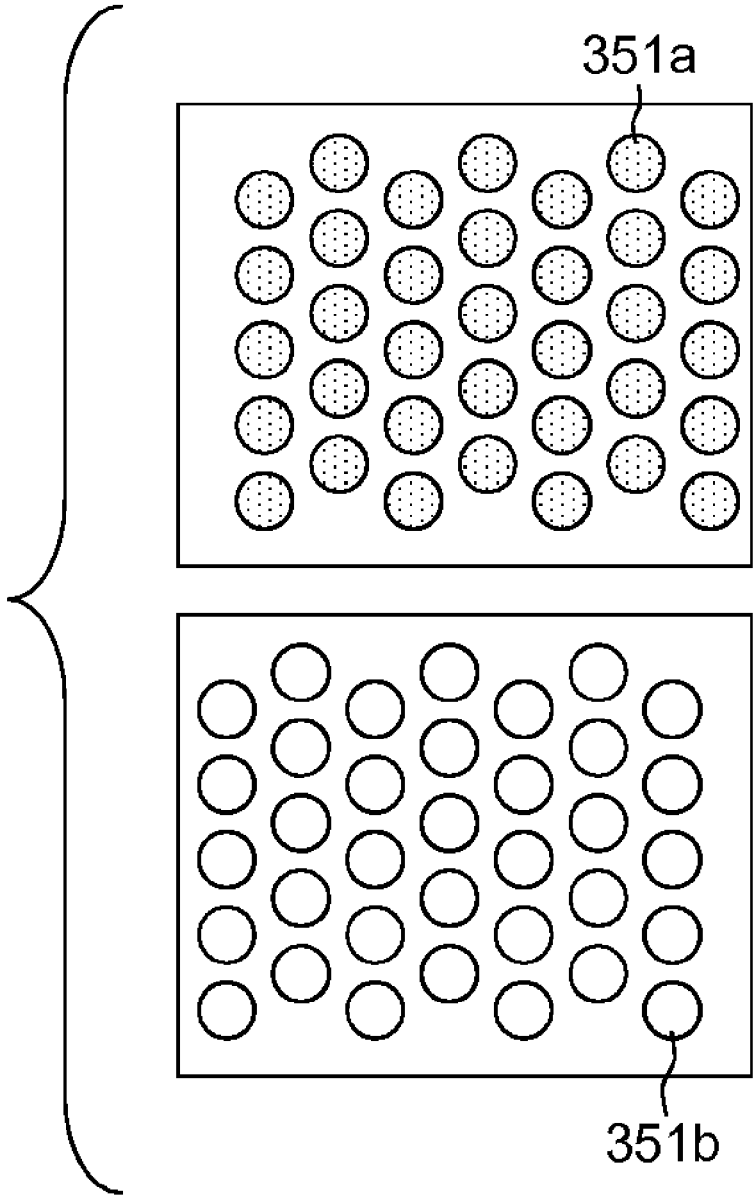
FIG. 12A shows an arrangement of suction holes and FIG. 12B shows the regions which are suctioned by the suction holes during the entire image forming process, which are different to those illustrated in FIG. 11A and FIG. 11B.
Figure 12B:
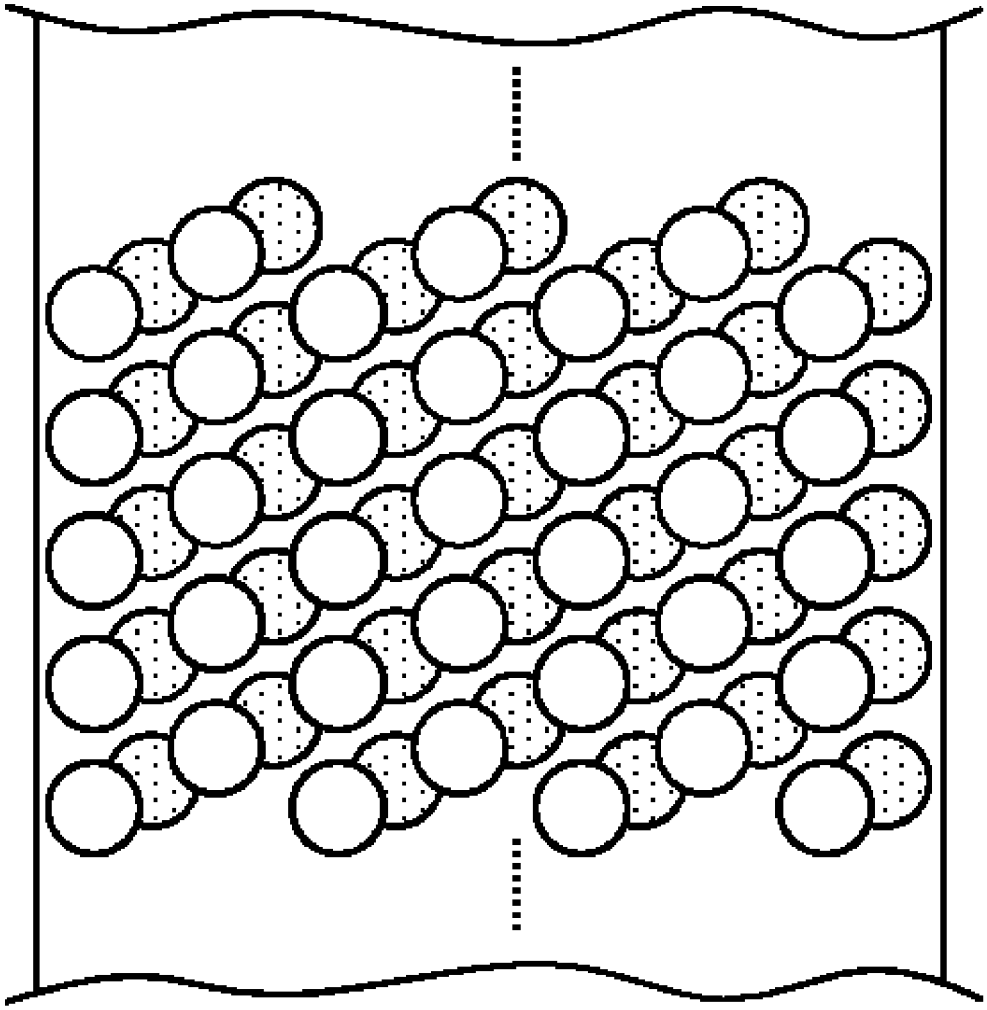

FIGS. 11A and 12A show A the arrangement of suction holes in the respective drums, and FIGS. 11B and 12B show the regions which are suctioned by the suction holes in the whole image forming process. As shown in FIGS. 11A and 11B, the arrangement of the suction holes is such that the arrangement of the suction holes 350*a* of one drum is different to the arrangement of the suction holes 350*b* of another drum, in such a manner that there may be no overlapping portions. Furthermore, if it is necessary to set a high ratio of openings in order to obtain a certain suctioning force (e.g. if the recording medium has high rigidity), then it is also possible to arrange the suction holes so that there are some overlapping portions, as shown in FIGS. 12A and 12B. In this case, by overlapping the suction holes in the edge portions where the depression is small, compared to the central portions of the suction holes, it is possible to obtain similar beneficial effects to a case where there are no overlapping portions at all, as shown in FIGS. 11A and 11B.

If the drums having different suction hole positions (altered suction hole positions) have the same arrangement of suction holes in the image formation unit 116 (image formation drum 170) and the drying unit 118 (drying drum 176), then the water content of the recording medium becomes highest, the rigidity of the recording medium becomes weak and suction marks become liable to occur in the recording medium, and hence this is especially not desirable. If suctioning is performed consecutively at the same positions in the treatment liquid deposition unit 114 (treatment liquid drum 154) and the image formation drum (image formation drum 170), or the drying unit 118 (drying drum 176) and the fixing unit 120 (fixing drum 184), then since the water content is lower, suction marks are less liable to occur, but this composition is not desirable. Desirably, the positions of the suction holes which make contact with the recording medium are made different at least in mutually adjacent drums. By ensuring that suction holes are not disposed in the same positions in consecutive fashion, suction marks are less liable to occur and it is possible to suppress the occurrence of depressions in the image.

Description of Control System

Figure 13:
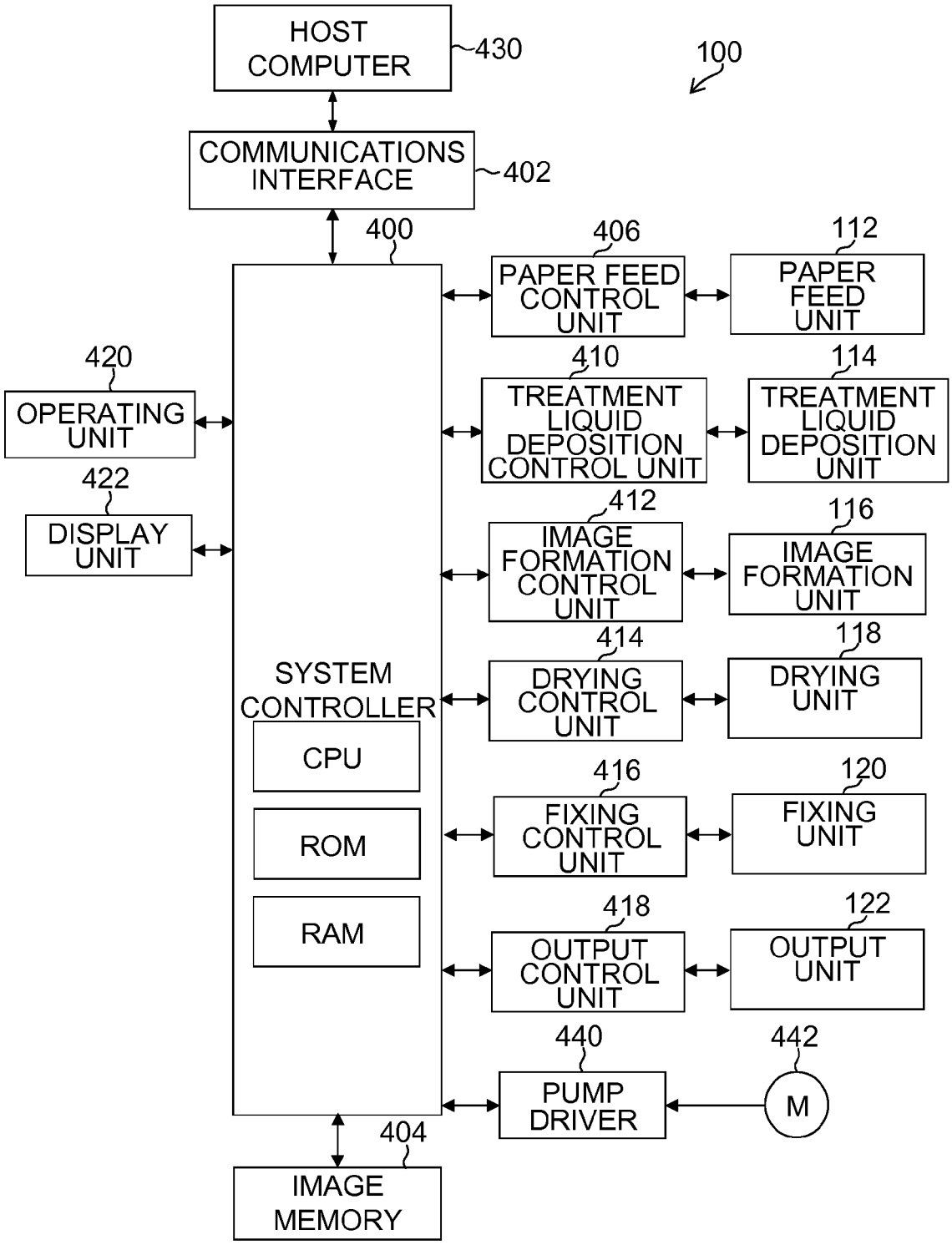
FIG. 13 is a principal block diagram showing a system composition of an inkjet recording apparatus.

FIG. 13 is a block diagram showing the approximate composition of the control system of the inkjet recording apparatus according to the present embodiment. FIG. 13 illustrates an inkjet recording apparatus using a drum conveyance method as shown in FIG. 6, but this composition may also be implemented similarly in an inkjet recording apparatus which uses a belt conveyance method.

As shown in FIG. 13, the inkjet recording apparatus 100 comprises: a system controller 400, a communications interface 402, an image memory 404, a paper feed control unit 406, a treatment liquid deposition control unit 410, an image formation control unit 412, a drying control unit 414, a fixing control unit 416, a paper output control unit 418, an operating unit 420, a display unit 422, and the like.

The system controller 400 is a control unit which controls the respective units of the inkjet recording apparatus 100, as well as serving as a processing unit which carries out various calculating processes, and is constituted by a CPU, ROM, RAM, and the like. The system controller 400 controls the respective units of the inkjet recording apparatus 100 in accordance with prescribed control programs. The control programs which are executed by the system controller 400 and various data required for control purposes are stored in a ROM.

The communications interface 402 is an interface unit for receiving image data which is transmitted by a host computer 430. The image data sent from the host computer 430 is read into the inkjet recording apparatus 100 via this communications interface 402.

The image memory 404 is a storage device which temporarily stores the image data, and data is read from and written to the memory via the system controller 400. The image data read in from the host computer 430 via the communications interface 402 is stored in this image memory 404.

The paper feed control unit 406 controls the driving of the respective units (paper feed drum 152, and the like) which constitute the paper feed unit 112 in accordance with instructions from the system controller 400.

The treatment liquid deposition control unit 410 controls the driving of the respective units (treatment liquid drum 154, treatment liquid application apparatus 156, and the like) which constitute the treatment liquid deposition unit 114 in accordance with instructions from the system controller 400.

The image formation control unit 412 controls the driving of the respective units (image formation drum 170, inkjet heads 172M, 172K, 172C, 172Y, and the like) which constitute the image formation unit 116 in accordance with the instructions from the system controller 400.

The drying control unit 414 controls the driving of the respective units (drying drum 176, solvent drying apparatus 178, and the like) which constitute the drying unit 118 in accordance with instructions from the system controller 400. Furthermore, the drying control unit 414 also controls the temperature of the drying drum 176.

The fixing control unit 416 controls the driving of the respective units (fixing drum 184, halogen heater 186, fixing roller 188, and the like) which constitute the fixing unit 120 in accordance with instructions from the system controller 400.

The paper output control unit 418 controls the driving of the respective units (transfer drum 194, conveyance belt 196, and the like) which constitute the output unit 122 in accordance with instructions from the system controller 400.

The operating unit 420 comprises a required operating device (operating buttons, keyboard, touch panel, and the like), and outputs operating information input via the operating device to the system controller 400.

A pump driver 440 controls a vacuum pump 442 which generates a suction pressure for holding and fixing the recording medium 22 onto the treatment liquid drum 154, the image formation drum 170, the drying drum 176 and the fixing drum 184. Furthermore, the pump driver 440 also controls the vacuum pump 442 in order to hold and fix the recording medium 22, onto the intermediate conveyance units 126, 128, 130, and the like.

Moreover, in the case of an inkjet recording apparatus which conveys the medium on the same suction surface as shown in FIG. 1, desirably, a data table is created indicating the suction pressure and the timetables shown in FIGS. 5A to 5D, in accordance with the type and thickness of the recording medium, and the droplet ejection conditions, such as the ink droplet ejection volume, and this data table is stored in the prescribed memory. By inputting the conditions, it is possible to form an image using a desirable suction time and suction force.

The display unit 422 comprises a required display apparatus (LCD panel, or the like), which causes the display apparatus to show required information in accordance with instructions from the system controller 400.

As stated previously, image data is read into the inkjet recording apparatus 100 from the host computer 430 via the communications interface 402, and the image data is stored in the image memory 404. The system controller 400 generates dot data by carrying out required signal processing on the image data stored in the image memory 404. The image represented by the image data is printed onto the recording medium 22, by controlling the driving of the inkjet heads 172M, 172K, 172C and 172Y of the image formation unit 116 in accordance with the generated dot data.

In general, the dot data is generated by subjecting the image data to color conversion processing and halftone processing.

The color conversion processing is processing for converting image data represented by a sRGB system, for instance (for example, 8-bit RGB image data) into color data of the respective colors of ink used by the inkjet recording apparatus (KCMY color data, in the present embodiment).

Halftone processing is processing for converting the color data of the respective colors generated by the color conversion processing, into dot data of respective colors (in the present embodiment, KCMY dot data) by error diffusion processing, or the like.

The system controller 400 generates dot data of the respective colors of C, M, Y and K by applying color conversion processing and halftone processing to the image data. The image represented by the image data is printed onto the recording medium 22, by controlling the driving of the corresponding inkjet heads 172M, 172K, 172C and 172Y in accordance with the generated dot data of the respective colors.

Inkjet recording apparatuses and inkjet recording methods according to embodiments of the present invention have been described in detail above, but the present invention is not limited to the aforementioned examples, and it is of course possible for improvements or modifications of various kinds to be implemented, within a range which does not deviate from the essence of the present invention.

Recording Medium

In the present invention, it is possible to form an image with high accuracy, irrespective of the type of recording medium. It is suitable to use one of the recording media cited below, and by using coated paper, it is possible to slow the permeation of the ink solvent, which means that reduction of the rigidity of the recording medium is suppressed, suction marks become less liable to occur. Therefore, it is particularly desirable to use coated paper.

It is suitable to use gloss or matte paper, such as commercial paper board, cast coated paper, art paper, coated paper, thin-coated paper, top-grade paper, copy paper, recycled paper, synthetic paper, medium-grade paper, pressure-sensitive paper, embossed paper, or the like, and it is also possible to use special inkjet paper. Furthermore, it is also possible to use a resin film or a metal vapor deposition film, and the like. Desirable examples of the recording medium are media having a basis weight of 60 to 350 g/m$^2$, such as: OK L Card+ (made by Oji Paper Co., Ltd.), SA Kinfuji+ (SA Golden Cask+) (made by Oji Paper Co., Ltd.), Satin Kinfuji (Golden Cask) N (made by Oji Paper Co., Ltd.), OK Top Coat+ (made by Oji Paper Co., Ltd.), New Age (made by Oji Paper Co., Ltd.), Tokubishi Art double-side N (made by Mitsubishi Paper Mills Ltd.), Tokubishi Art single-side N (made by Mitsubishi Paper Mills Co., Ltd.), New V Matt (made by Mitsubishi Paper Mills Co., Ltd.), Aurora Coat (made by Nippon Paper Group Inc.), Aurora L (made by Nippon Paper Group, Inc.), Silver Dia (made by Nippon Paper Group, Inc.), Urite (made by Nippon Paper Group, Inc.), Recycle Coat T-6 (made by Nippon Paper Group, Inc.), Recycle Matt T-6 (made by Nippon Paper Group, Inc.), ibest W (made by Nippon Paper Group, Inc.), Invercoat M (made by Span Corporation), Hi-Mckinley Art (made by Gojo Paper Mfg. Co. Ltd.), I-Best W (Nippon Daishowa Paperboard Ltd.), Kinmari Hi-L (made by Hokuetsu Kishu Paper Co. Ltd.), Signature True (made by NewPage Corp.), Sterling Ultra (made by NewPage Corp.), Anthem (made by NewPage Corp.), Hannoart Silk (made by Sappi), Hanno Art Gloss (made by Sappi), Consort Royal Semimatte (made by Papierfabrik Scheufelen), Consort Royal Gloss (made by Papierfabrik Scheufelen), Zanders Ikono Silk (made by M-real Corp.), and Zanders Ikono Gloss (made by M-real Corp.).

Ink

Ink used in embodiments of the present invention is an aqueous pigment-based ink containing pigment which is a coloring material (colorant) and thermoplastic resin particles, and the like.

Desirably, the density of the solvent-insoluble material is equal to or greater than 1 wt % and equal to or less than 20 wt %, taking account of the fact that the suitable viscosity for ejection is 20 mPa·s or lower. More desirably, the density of the pigment is 4 wt % or above, in order to obtain good optical density in the image.

Desirably, the surface tension of the ink is equal to or greater than 20 mN/m and equal to or less than 40 mN/m, taking account of ejection stability.

The coloring material used in the ink may be pigment particles or a combination of dye and pigment. From the viewpoint of the aggregating properties upon contact with the treatment liquid, a pigment which is in a dispersed state in the ink is desirable, since this aggregates more effectively. Of pigments, it is particularly desirable to use a pigment which is dispersed by a dispersant, a self-dispersing pigment, a pigment in which the surfaces of the pigment particles are covered with a resin (microcapsule pigment), or a polymer grafted pigment. Furthermore, from the viewpoint of the aggregating properties of the pigment, a more desirable mode is one where the pigment is modified with a carboxyl group having a low degree of disassociation.

Desirably, thermoplastic resin particles which do not contain a colorant are added to the colored ink liquid used in embodiments of the present invention, as a component which reacts with the treatment liquid. The thermoplastic resin particles enhance the aggregating action and viscosity increasing action of the ink upon reaction with the treatment liquid, and thereby make it possible to improve the image quality. In particular, it is possible to obtain an ink having high stability and safety by including anionic thermoplastic resin particles in the ink.

By using thermoplastic resin particles which produce a viscosity increasing action and aggregating action upon reaction with the treatment liquid as the ink, it is possible to improve image quality, while at the same time, depending on the types of the thermoplastic resin particles used, beneficial effects are obtained in further improving the weatherproofing, abrasion-resistant and waterproofing properties of the image due to the thermoplastic resin particles forming a coating on the recording medium.

The method of dispersion in polymer ink is not limited to an emulsion, and a solution may be used, and it may be present in the state of a colloidal dispersion.

The thermoplastic resin particles may be dispersed by using an emulsifier, or without using an emulsifier. For the emulsifier, generally, a surfactant of low molecular weight is used, but it is also possible to use a surfactant of high molecular weight as the emulsifier. It is also desirable to use capsule type thermoplastic resin particles in which the outer shell is made of acrylic acid, methacrylic acid, or the like (namely, core—shell type thermoplastic resin particles which have a different composition in the central portion and the outer edge portion).

Possible examples of a resin component which is added to the ink in the form of thermoplastic resin particles include: an acrylic resin, a vinyl acetate resin, a styrene-butadiene resin, a vinyl chloride resin, an acryl-styrene resin, a butadiene resin, a styrene resin, and the like.

A material having a carboxylic acid group with a low degree of disassociation is more desirable, from the viewpoint of imparting fast aggregating properties to the thermoplastic resin particles. Since the carboxylic acid group is liable to be affected by change in the pH, the state of dispersion is liable to change, and hence the aggregating properties are high.

The change in the state of dispersion of the thermoplastic resin particles caused by change in the pH can be adjusted by means of the content ratio of the constituent components of the thermoplastic resin particles which contain a carboxylic acid group, such as acrylic acid ester, or the like, and it can also be adjusted by means of an anionic surfactant which is used as a dispersant.

Desirably, the resin component of the thermoplastic resin particles is a polymer which has a hydrophilic part and a hydrophobic part. By incorporating a hydrophobic part, the hydrophobic part is oriented toward to the inner side of the thermoplastic resin particle, and the hydrophilic part is oriented efficiently toward the outer side, thereby having the effect of further increasing the change in the dispersion state caused by change in the pH of the liquid. Therefore, aggregation can be performed more efficiently.

Moreover, two or more types of thermoplastic resin particles may be used in combination in the ink.

It is possible to use an organic base or an inorganic alkaline base as a neutralizing pH adjuster (neutralizing agent) which is added to the ink according to embodiments of the present invention. Desirably, a pH adjuster is added so as to adjust the ink to a pH of 6 to 10, in order to improve the storage stability of the inkjet ink.

The ink according to embodiments of the present invention desirably contains a water-soluble organic solvent in order to prevent blockages of the nozzles of the inkjet head due to drying. A water-soluble organic solvent of this kind includes a moistening agent or a penetrating agent.

Similarly to the case of the treatment liquid, possible examples of the water-soluble organic solvent are: polyvalent alcohols, polyvalent alcohol derivatives, nitrogen-containing solvents, alcohols, sulfur-containing solvents, and the like.

Additionally, according to requirements, it is also possible to add a surfactant, a pH buffering agent, an antioxidant, an anti-rusting agent, a mildew-proofing agent, a viscosity adjuster, a conducting agent, an ultraviolet absorber, or the like.

Furthermore, by including a UV-curable monomer in the ink, after sufficiently evaporating off the water content in the drying unit, it is possible to cure and polymerize the UV-curable monomer and thereby improve the image strength by irradiating ultraviolet light onto the image by means of a fixing unit comprising an ultraviolet light irradiation lamp.

Furthermore, by including a UV-curable monomer in the ink, after sufficiently evaporating off the water content in the drying unit, it is possible to cure and polymerize the UV-curable monomer and thereby improve the image strength by irradiating ultraviolet light onto the image by means of a fixing unit comprising an ultraviolet light irradiation lamp.

The UV-curable monomer produces a polymerization or cross-linking reaction due to initiating species, such as radicals, generated from the polymerization initiator, or the like, and has a function of curing the composition which contains these.

The UV-curable monomer can use a commonly known polymerizable or cross-linkable material which produces a polymerizing or cross-linking reaction, such as a radical polymerization reaction or a dimerization reaction, or the like. Possible examples are an addition polymerizable compound having at least one ethylenically unsaturated double bond, a high polymer compound having a maleimide group in a side chain, or a high polymer compound having a cinnamyl group, cinnamylidene group or a chalcone group having a photodimerizable unsaturated double bond adjacent to an aromatic nucleus, in a side chain. Of these, an addition polymerizable compound having at least one ethylenically unsaturated double bond is more desirable, and such a compound selected from compounds (monofunctional or polyfunctional compounds) having at least one and desirably two or more ethylenically unsaturated terminal bonds is especially desirable. More specifically, it is possible to select a compound appropriately from compounds which are commonly known in the industrial field of the present invention, and this includes, for example, monomers, pre-polymers (namely, dimers, trimers or oligomers), or mixtures of these, and chemical forms such as copolymers of same.

It is possible to use either one type of UV-curable monomer independently, or a combination of two or more types of UV-curable monomer.

As the UV-curable monomer which can be used in embodiments of the present invention, it is particularly desirable to use one of various commonly known radically polymerizable monomers which produce a polymerization reaction due to initiating species which are generated from the radical initiating agent.

Possible examples of radical polymerizable monomers are: (meth)acrylates, (meth)acrylamides, aromatic vinyls, vinyl ethers, and compounds having an internal double bond (maleic acid, and the like). Here, "(meth)acrylate" means any one or both of "acrylate" and "methacrylate", and "(meth)acryl" means any one or both of "acryl" and "methacryl".

Treatment Liquid

A desirable treatment liquid (aggregating treatment liquid) for used in implementing embodiments of the present invention is a treatment liquid which alters the pH of the ink so as to cause aggregation of the pigment and thermoplastic resin particles contained in the ink, thus producing an aggregate material.

Desirably, the component of the treatment liquid is selected from: polyacrylic acid, acetic acid, glycol acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, and derivatives of these compounds, and salts of these, and the like.

A desirable example of the treatment liquid is a treatment liquid to which a multivalent metallic salt or polyallylamine has been added. These compounds may be used singly, or a combination of two or more of these compounds may be used.

From the viewpoint of the pH aggregating performance with respect to the ink, the treatment liquid desirably has a pH of 1 to 6, more desirably, a pH of 2 to 5, and especially desirably, a pH of 3 to 5.

Furthermore, from the viewpoint of preventing nozzle blockages in the inkjet head due to drying, desirably, the treatment liquid also contains water or another additive-soluble organic solvent. The water or other organic solvent capable of dissolving the additive includes a moistening agent or a penetrating agent. These solvents can be used independently, or in plural fashion, together with the other additive.

It is also possible to further include a resin component in the treatment liquid in order to improve the fixing characteristics, abrasion-resistant and weatherproofing. The resin component may be any resin which would not impair the ejection characteristics from the head if the treatment liquid is ejected in the form of droplets by an inkjet method, and which has stable storage characteristics, and it is possible freely to choose a water-soluble resin, resin emulsion, or the like.

Additionally, according to requirements, it is also possible to add a surfactant, a pH buffering agent, an antioxidant, an anti-rusting agent, a mildew-proofing agent, a viscosity adjuster, a conducting agent, an ultraviolet absorber, or the like.

Practical Examples

Embodiments of the present invention is described in more specific terms below with reference to practical examples, but the present invention is not limited to these examples.

Preparation of Ink Composition

Dispersion of pigment-containing resin particles: 39.2 wt % (percent by mass)

Aqueous dispersion of self-dispersing thermoplastic resin particles: 28.6 wt %

GP-250 (made by Sanyo Chemical Industries, Ltd.): 8.0 wt %

Tripropylene monomethyl ether: 8.0 wt %

Olefin E1010 (made by Nisshin Chemical Industry Co., Ltd.): 1.0 wt %

Urea: 5.0 wt %

Deionized water: remainder

In the preparation described above, a cyan ink composition C-1, a magenta ink composition M-1, a yellow ink composition Y-1 and a black ink composition Bk-1 were manufactured.

Preparation of Treatment Liquid

A treatment liquid was prepared by mixing the respective components so as to achieve the composition described below.

Malonic acid (made by Wako Pure Chemical Industries, Ltd.): 11.3 wt %

Malic acid (made by Wako Pure Chemical Industries, Ltd.)): 14.5 wt %

DEGmBE (diethylene glycol monobutyl ether): 7.5 wt %

TEGmBE (triethylene glycol monomethyl ether): 2.5 wt %

Deionized water: remainder

Test Results

Images were formed using the inkjet recording apparatus based on a belt conveyance method shown in FIG. 1 (same suction surface). A solid image was formed by ejecting droplets at a droplet ejection volume of 13.4 g/m$^2$ onto a half-Kiku size (636 mm×469 mm) recording medium (OK top coat+, basis weight: 73.3 to 104.7 g/m$^2$; Ibest 210, basis weight: 210 g/m$^2$) (made by Oji Paper Co., Ltd.)) using a cyan ink composition C-1, a magenta ink composition M-1, a yellow ink composition Y-1 and a black ink component Bk-1, and the results were evaluated.

The occurrence of suction marks, wrinkles, and floating up of the trailing end during conveyance on a curved surface were evaluated in the images obtained. The evaluation was based on the following criteria.

Evaluation of Suction Marks

A sensory evaluation was made visually, of the solid images of 500 mm×500 mm size.

○: Suction marks not observed

○Δ: Suction marks observed in parts, but within tolerances

Δ: Suction marks observed; outside tolerances x: Marked occurrence of suction marks; outside tolerances Evaluation of Wrinkling The image portion was evaluated after printing 200 pages.

○: Wrinkling not observed in the image portion

○Δ: Several samples with slight wrinkling in the image portion observed

Δ: Several samples with wrinkling in the image portion observed x: Five or more samples with wrinkling in the image portion observed Floating up of Trailing end During Conveyance on Curved Surface Floating up of the trailing end was observed during conveyance by suctioning on a pressure drum having a diameter of 450 mm.

○: No floating up of the trailing end

○Δ: Slight floating up of the trailing, but within tolerances

Figure 14A:
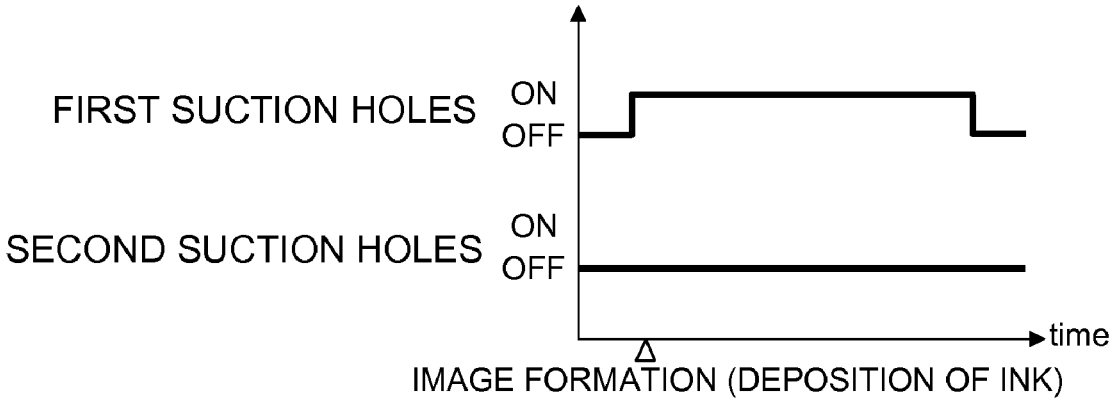
FIGS. 14A and 14B are timetables showing the switching times of suction regions according to a comparative example.
Figure 14B:
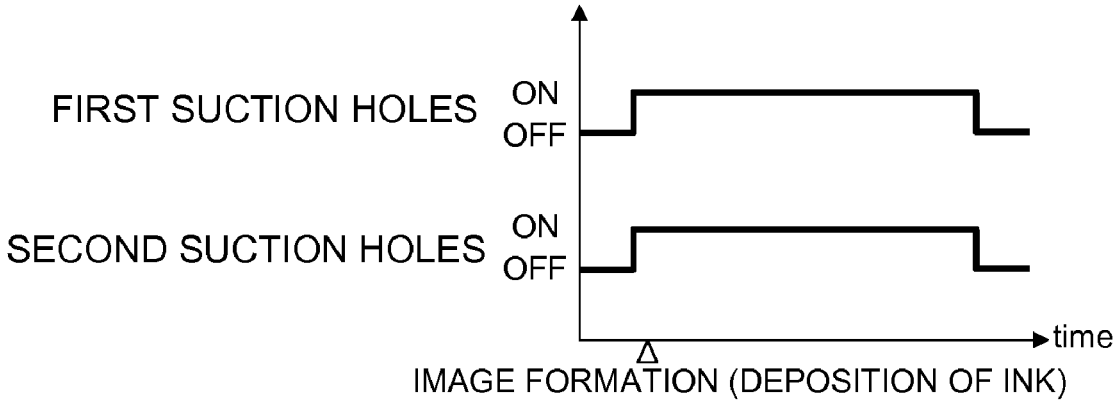

Δ: Floating up of the trailing end; outside tolerances x: Marked floating up of the trailing end The intervals of the suction times were set as indicated by the timetables in FIGS. 5A to 5D. Furthermore, as a comparative example, suctioned conveyance was carried out using the timetables indicated in FIGS. 14A and 14B, where FIG. 14A illustrates a case where suctioning is performed by the first suction holes during the whole of image formation and FIG. 14B illustrates a case where suctioning is performed by both sets of suction holes during the whole of image formation. Table 1 shows the results for suction marks, Table 2 shows the results for wrinkling, and Table 3 shows the floating up of the trailing end during conveyance on a curved surface.

TABLE 1

(Suction Marks)

| Practical Example/ Comparative Example | Control timetable for suction holes | Basis Weight [gsm] 73.3 | 104.7 | 127 | 157 | 210 |
|---|---|---|---|---|---|---|
| Practical Example 1 | FIG. 5A | Δ | ○ | ○ | ○ | ○ |
| Practical Example 2 | FIG. 5B | ○ | ○ | ○ | ○ | ○ |
| Comparative Example 1 | FIG. 14A | x | Δ | ○ | ○ | ○ |
| Comparative Example 2 | FIG.14B | x | x | ○ | ○ | ○ |
| Practical Example 3 | FIG. 5C | Δ | ○ | ○ | ○ | ○ |
| Practical Example 4 | FIG. 5D | ○ | ○ | ○ | ○ | ○ |

TABLE 2

(Wrinkling)

| Practical Example/ Comparative Example | Control timetable for suction holes | Basis weight [gsm] 73.3 | 104.7 |
|---|---|---|---|
| Practical Example 1 | FIG. 5A | ○Δ | ○ |
| Practical Example 2 | FIG. 5B | Δ | ○ |
| Practical Example 3 | FIG. 5C | ○ | ○ |
| Practical Example 4 | FIG. 5D | ○ | ○ |

TABLE 3

| (Floating up of trailing end during conveyance on curved surface) | | | |
|---|---|---|---|
| Practical Example/Comparative Example | Control timetable for suction holes | Basis weight [gsm] 157 | 210 |
| Practical Example 1 | FIG. 5A | ○ | Δ |
| Practical Example 2 | FIG. 5B | ○ | Δ |
| Comparative Example 1 | FIG. 14A | ○ | ○Δ |
| Comparative Example 2 | FIG. 14B | ○ | ○ |

According to Practical Examples 1 and 2, it was possible to form images without creating suction marks in thin paper, by shortening the suction time in each suctioning operation. In Comparative Example 1 in which switching of the suctioning was not carried out, and Comparative Example 2 in which suctioning was performed in the whole region of the suction holes, without switching, due to the high suction force, it was possible to convey even thick paper without floating up of the trailing end during conveyance on a curved surface, but suction marks were observed in the case of thin paper.

Furthermore, it is also possible to prevent the occurrence of wrinkling during switching of suction holes, by overlapping the end of the one set of suction holes with the start of the other set of suction holes during switching.

Images were formed using the inkjet recording apparatus based on a drum conveyance method shown in FIG. 6 (a plurality of suction surfaces). Images were formed by using the same materials as the practical examples described above in respect of the ink and recording medium, and changing the arrangement of the suction holes in the respective drums. Table 4 relates to a practical example in which the suction holes of the image formation drum and the suction holes of the drying drum were arranged in mutually different positions, and Table 5 relates to a practical example in which the arrangement of suction holes was changed in the treatment liquid drum, the image formation drum, the drying drum and the fixing drum. In Tables 4 and 5, the arrangement of the suction holes was set in such a manner that the suction holes labeled with the same reference numerals were in the same arrangement. Furthermore, in the practical example in Table 4, suctioning was not performed in the treatment liquid drum and the fixing drum. Evaluation was made by checking the image portion visually for suction marks. Furthermore, the evaluation method employed the same criteria as the practical examples described above.

TABLE 4

| Practical Example/ Comparative Example | Arrangement of suction holes: Image formation drum | Drying drum | Basis Weight [gsm] 73.3 | 104.7 | 127 | 157 | 210 |
|---|---|---|---|---|---|---|---|
| Comparative Example 3 | A | A | x | Δ | ○ | ○ | ○ |
| Practical Example 5 | A | B | ○ | ○ | ○ | ○ | ○ |

TABLE 5

| Practical Example/ Comparative Example | Arrangement of suction holes: Treatment liquid drum | Image formation drum | Drying drum | Fixing drum | Basis weight[gsm] 73.3 | 104.7 | 127 | 157 | 210 |
|---|---|---|---|---|---|---|---|---|---|
| Comparative Example 4 | A | A | A | A | x | x | Δ | ○ | ○ |
| Comparative Example 5 | A | A | A | B | x | x | ○Δ | ○ | ○ |
| Comparative Example 6 | A | A | B | B | x | x | ○ | ○ | ○ |
| Comparative Example 7 | A | A | B | C | x | Δ | ○ | ○ | ○ |
| Practical Example 6 | A | B | C | D | ○ | ○ | ○ | ○ | ○ |
| Comparative Example 8 | A | B | B | C | x | x | ○ | ○ | ○ |
| Comparative Example 9 | A | B | B | A | x | x | ○ | ○ | ○ |
| Practical Example 7 | A | B | C | A | ○Δ | ○ | ○ | ○ | ○ |
| Practical Example 8 | A | B | C | B | ○Δ | ○ | ○ | ○ | ○ |
| Comparative Example 10 | A | B | C | C | Δ | ○ | ○ | ○ | ○ |

As shown in Table 4 and Table 5, suction marks were observed in thin paper when suctioning surfaces having the same arrangement of suction holes were disposed consecutively. The occurrence of suction marks was especially notable when the arrangement of suction holes was the same, in consecutive fashion, in the image formation drum and the drying drum where the amount of water contained in the recording medium is high. Conversely, even if the arrangement of suction holes was the same in the treatment liquid drum and the image formation drum, and in the drying drum and the fixing drum, since the amount of water contained in the recording medium was small, there was little effect of the occurrence of suction marks even if the medium was suctioned consecutively.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

a conveyance device including:

a surface sheet which has a plurality of suction apertures and is configured to come into contact with a rear surface of a recording medium reverse to an image forming surface of the recording medium; and a conveyance device surface which has a plurality of suction holes and is configured to face the rear surface of the recording medium across the surface sheet, the conveyance device conveying the recording medium along with the surface sheet while suctioning the rear surface of the recording medium onto the surface sheet with a negative pressure through the suction holes in the conveyance device surface and the suction apertures in the surface sheet while changing suction locations of the surface sheet and the rear surface of the recording medium suctioned via the suction holes in the conveyance device surface;

an inkjet head for ejecting and depositing ink onto the image forming surface of the recording medium conveyed by the conveyance device in such a manner that an image is formed on the image forming surface of the recording medium; and a control device which changes the suction locations of the surface sheet and the rear surface of the recording medium suctioned via the suction holes in the conveyance device surface, at a prescribed interval.

2. The inkjet recording apparatus as defined in claim 1, wherein the conveyance device is a device which uses a same suction surface of the surface sheet to perform conveyance from a start to an end of the conveyance, and includes a switching device for changing the suction locations.

3. The inkjet recording apparatus as defined in claim 2, wherein the switching device opens and closes the plurality of suction holes in the conveyance device surface.

4. The inkjet recording apparatus as defined in claim 2, wherein the switching device switches flow channels connected to the plurality of suction holes in the conveyance device surface.

5. The inkjet recording apparatus as defined in claim 1, wherein the conveyance device includes a plurality of suction conveyance units, arrangement of the suction holes in the conveyance device surface in one suction conveyance unit being different from arrangement of the suction holes in the conveyance device surface in another suction conveyance unit so as to change the suction locations.

6. The inkjet recording apparatus as defined in claim 5, wherein the plurality of suction conveyance units are provided at a location corresponding to the inkjet head.

7. The inkjet recording apparatus as defined in claim 1, wherein the control device controls changing of the suction locations according to time.

8. The inkjet recording apparatus as defined in claim 7, wherein the control device controls the changing of the suction locations in such a manner that there is overlap between time periods during which suctioning is performed via the suction holes in the conveyance device surface before and after the changing.

9. The inkjet recording apparatus as defined in claim 1, further comprising a drying device which heats the ink deposited on the image forming surface of the recording medium.

10. The inkjet recording apparatus as defined in claim 9, wherein:

the conveyance device includes a plurality of suction conveyance units, arrangement of the suction holes in the conveyance device surface in one suction conveyance unit being different from arrangement of the suction holes in the conveyance device surface in another suction conveyance unit so as to change the suction locations, and the plurality of suction conveyance units are provided respectively at locations corresponding to the inkjet head and the drying device.

11. The inkjet recording apparatus as defined in claim 1, further comprising a treatment liquid deposition device which deposits treatment liquid having a function of aggregating or increasing viscosity of a component of the ink, onto the image forming surface of the recording medium.

12. The inkjet recording apparatus as defined in claim 11, wherein:

the conveyance device includes a plurality of suction conveyance units, arrangement of the suction holes in the conveyance device surface in one suction conveyance unit being different from arrangement of the suction holes in the conveyance device surface in another suction conveyance unit so as to change the suction locations, and the plurality of suction conveyance units are provided respectively at locations corresponding to the treatment liquid deposition device and the inkjet head.

13. The inkjet recording apparatus as defined in claim 1, wherein the ink contains thermoplastic resin particles.

14. The inkjet recording apparatus as defined in claim 13, further comprising:

a drying device which heats the ink deposited on the image forming surface of the recording medium; and a fixing device which heats and pressurizes the recording medium after the drying device in terms of a direction of conveyance of the recording medium.

15. The inkjet recording apparatus as defined in claim 14, further comprising a treatment liquid deposition device which deposits treatment liquid having a function of aggregating or increasing viscosity of a component of the ink, onto the image forming surface of the recording medium, wherein:

the conveyance device includes a plurality of suction conveyance units, arrangement of the suction holes in the conveyance device surface in one suction conveyance unit being different from arrangement of the suction holes in the conveyance device surface in another suction conveyance unit so as to change the suction locations, and the plurality of suction conveyance units are provided respectively at locations corresponding to the treatment liquid deposition device, the inkjet head, the drying device and the fixing device.

16. The inkjet recording apparatus as defined in claim 15, wherein arrangement of the suction holes in the conveyance device surface is made different between the suction conveyance units which are mutually adjacent, of the plurality of suction conveyance units.

17. The inkjet recording apparatus as defined in claim 1, wherein:

the ink contains a UV-curable monomer; and the inkjet recording apparatus further comprises a fixing device based on irradiation of UV light.

18. The inkjet recording apparatus as defined in claim 1, wherein the recording medium is coated paper.

19. The inkjet recording apparatus as defined in claim 1, wherein the inkjet head is a full line type inkjet head.

20. An inkjet recording method comprising:

a conveyance step of conveying a recording medium along with a surface sheet of a conveyance device which includes: the surface sheet which has a plurality of suction apertures and is configured to come into contact with a rear surface of the recording medium reverse to an image forming surface of the recording medium; and a conveyance device surface which has a plurality of suction holes and is configured to face the rear surface of the recording medium across the surface sheet, while suctioning the rear surface of the recording medium onto the surface sheet with a negative pressure through the suction holes in the conveyance device surface and the suction apertures in the surface sheet while changing suction locations of the surface sheet and the rear surface of the recording medium suctioned via the suction holes in the conveyance device surface at a prescribed interval; and an ink ejection step of ejecting and depositing ink droplets onto the image forming surface of the recording medium to form an image; on the image forming surface of the recording medium while the recording medium is being conveyed in the conveyance step.

* * * * *